US008837978B2

(12) United States Patent
Wada et al.

(10) Patent No.: US 8,837,978 B2
(45) Date of Patent: Sep. 16, 2014

(54) SLIDE RAIL ASSEMBLY AND IMAGE FORMING APPARATUS WITH THE SAME

(71) Applicant: KYOCERA Document Solutions Inc., Osaka (JP)

(72) Inventors: Hiroshi Wada, Osaka (JP); Masafumi Miki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/159,359

(22) Filed: Jan. 20, 2014

(65) Prior Publication Data

US 2014/0203697 A1 Jul. 24, 2014

(30) Foreign Application Priority Data

Jan. 24, 2013 (JP) ..... 2013-010872

(51) Int. Cl.
*G03B 15/00* (2006.01)
*A47B 88/14* (2006.01)
*A47B 88/04* (2006.01)

(52) U.S. Cl.
CPC ..... *A47B 88/14* (2013.01); *A47B 88/0418* (2013.01)
USPC ..... 399/107

(58) Field of Classification Search
CPC ..... A47B 88/14; A47B 88/0418
USPC ..... 399/107
See application file for complete search history.

(56) References Cited

U.S. PATENT DOCUMENTS

| | | | | |
|---|---|---|---|---|
| 6,238,031 | B1 * | 5/2001 | Weng | 312/333 |
| 6,390,575 | B1 * | 5/2002 | Chen et al. | 312/334.46 |
| 6,402,275 | B1 * | 6/2002 | Yang | 312/334.46 |
| 6,450,600 | B1 * | 9/2002 | Chen et al. | 312/334.46 |
| 6,764,150 | B2 * | 7/2004 | Le et al. | 312/334.46 |
| 8,528,999 | B2 * | 9/2013 | Chen et al. | 312/334.45 |
| 2007/0164645 | A1 * | 7/2007 | Chen et al. | 312/334.47 |
| 2008/0231153 | A1 * | 9/2008 | Cho | 312/333 |
| 2010/0008608 | A1 * | 1/2010 | Chen et al. | 384/45 |
| 2011/0081104 | A1 * | 4/2011 | Chiang | 384/19 |
| 2013/0058596 | A1 * | 3/2013 | Chen et al. | 384/7 |
| 2013/0156353 | A1 * | 6/2013 | Rehage | 384/22 |
| 2014/0056546 | A1 * | 2/2014 | CHEN et al. | 384/22 |

FOREIGN PATENT DOCUMENTS

| | | | |
|---|---|---|---|
| JP | 2001-304255 | A | 10/2001 |
| JP | 2007-000253 | A | 1/2007 |

* cited by examiner

*Primary Examiner* — Rodney Fuller
(74) *Attorney, Agent, or Firm* — Knobbe, Martens, Olson & Bear LLP

(57) ABSTRACT

A slide rail assembly includes a fixed rail, a movable rail, and a lever member engageable to the fixed rail. In a state where the movable rail is fully removed from the fixed rail, the lever member locks a ball retainer against sliding movement relative to the fixed rail. In a state where the movable rail is assembled to the fixed rail, the lever member releases the locking of the ball retainer. The lever member includes a pressure receiving portion projectable through a window portion of the ball retainer. During reassembly of the movable rail to the fixed rail, the pressure receiving portion is pressed by a pressing portion of the movable rail, so that the locking of the ball retainer by the lever member is released.

12 Claims, 26 Drawing Sheets

SLIDE RAIL ASSEMBLY AND IMAGE FORMING APPARATUS WITH THE SAME

INCORPORATION BY REFERENCE

This application claims priority to Japanese Patent Application No. 2013-10872 filed on Jan. 24, 2013, the entire contents of which are incorporated by reference herein.

BACKGROUND

The present disclosure relates to a slide rail assembly including a fixed rail and a movable rail; and an image forming apparatus with the slide rail assembly.

Image forming apparatuses, such as printers, copiers, and facsimile machines, include those in which a portion of the apparatus body or a unit housed in the apparatus body can be pulled horizontally outward. For example, there is known an image forming apparatus configured so that a sheet conveyance unit assembled integrally on one sidewall of the apparatus body can be pulled outwardly from the apparatus body. In this case, a slide rail assembly is applied to the unit in order to facilitate the outward pulling and subsequent fitting back of the unit. The slide rail assembly includes a fixed rail and a movable rail. The fixed rail and the movable rail are mounted to the apparatus body and the unit, respectively. Generally, the movable rail is held by a ball retainer movable within the fixed rail.

The range of sliding movement of the movable rail, i.e., the range in which the movable rail can be slid out from the fixed rail, is restricted by a stopper. However, during maintenance or the like, the stopper may be removed and the unit may be fully separated from the apparatus body. In doing so, the movable rail is also removed from the ball retainer and separated, together with the unit, from the apparatus body. In reassembling the unit into the apparatus body after the end of the maintenance work or the like, the movable rail is inserted into the ball retainer. At this time, however, since the ball retainer is free to move relative to the fixed rail, the ball retainer is often located behind an apparatus body plane from which the unit is pulled outwardly. In this case, the movable rail may not be able to be easily reassembled to the ball retainer.

For example, a slide rail assembly is known in which a support member is provided at the distal end of the fixed rail in order to facilitate the reassembly of the separated movable rail to the fixed rail. However, the placement of the support member leads to constant frictional contact of the support member with the movable rail, which impedes smooth pulling of the unit. In other words, an operational feeling of smooth sliding intrinsic to the ball retainer is impaired.

SUMMARY

A technique further modified from the above known techniques is proposed as an aspect of the present disclosure.

A slide rail assembly according to one aspect of the present disclosure includes a fixed rail, a movable rail, a holding member, and a fixing part.

The fixed rail includes a guiding portion extending in a single direction.

The movable rail is changeable among a first state where the movable rail is retracted in the fixed rail, a second state where the movable rail partly extends out from the fixed rail by sliding in the single direction while being guided by the guiding portion, and a third state where the movable rail is fully removed from the fixed rail.

The holding member is assembled to the fixed rail, is configured to be slidable along the guiding portion in a range of longitudinal extension of the guiding portion, and holds the movable rail to allow sliding movement of the movable rail.

The fixing part is configured to, in the third state of the movable rail, lock the holding member against sliding movement relative to the fixed rail and, in the first and second states of the movable rail, release the locking of the holding member.

An image forming apparatus according to another aspect of the present disclosure includes an apparatus body, a unit, and the slide rail assembly.

The apparatus body houses devices for use in forming an image.

The unit is capable of being horizontally pulled out of the apparatus body.

The slide rail assembly supports the unit to allow horizontal sliding movement of the unit.

The fixed rail is mounted to the apparatus body and the movable rail is mounted to the unit.

BRIEF DESCRIPTION OF THE DRAWINGS

FIG. 7 is perspective views of the slide rail assembly, in which

DETAILED DESCRIPTION

Figure 1:
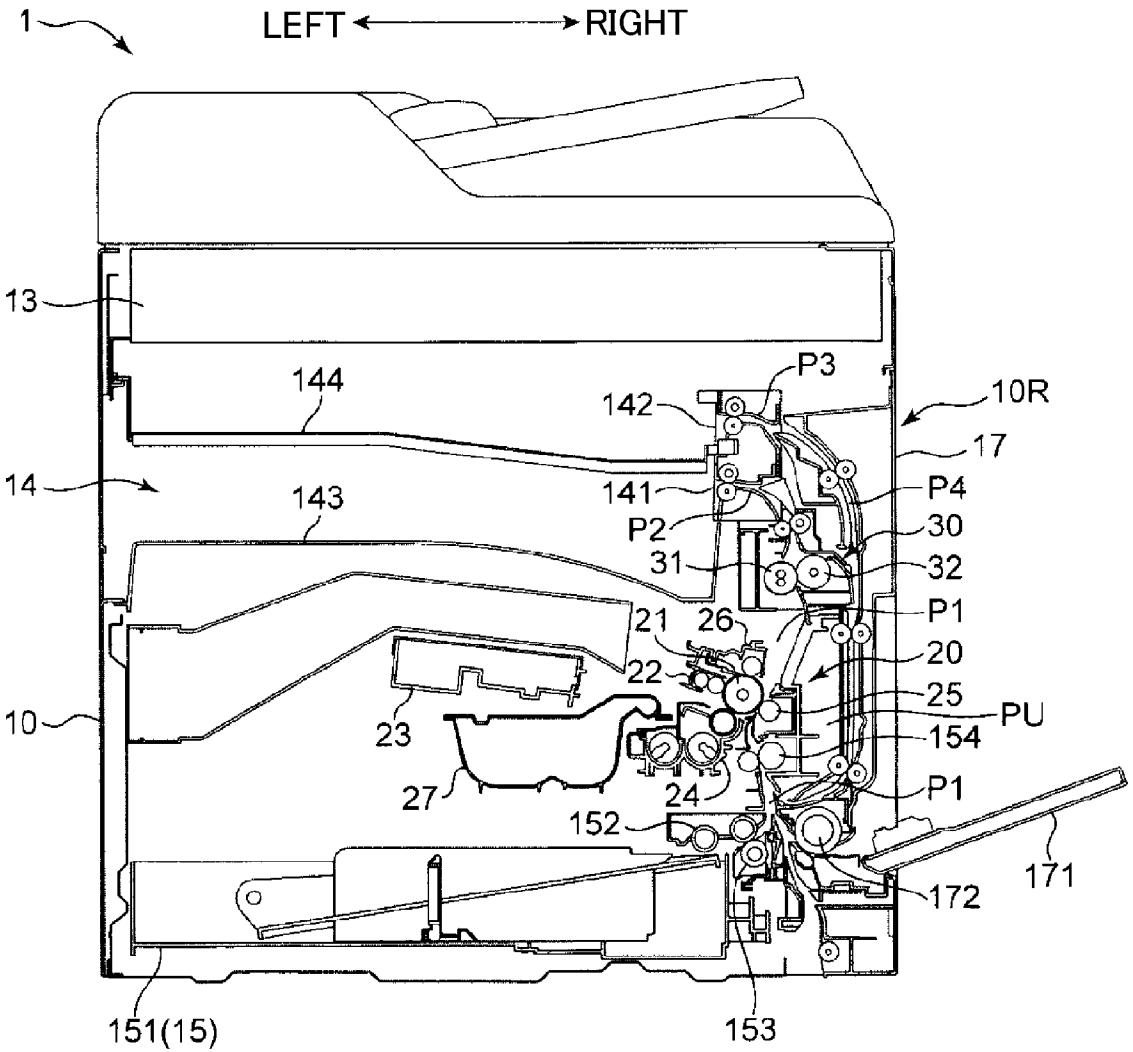
FIG. 1 is a cross-sectional view showing an internal structure of an image forming apparatus according to an embodiment of the present disclosure.

Hereinafter, a detailed description will be given of an embodiment of the present disclosure with reference to the drawings. FIG. 1 is a cross-sectional view showing an internal structure of an image forming apparatus 1 according to an embodiment of the present disclosure. An image forming apparatus 1 is a black-and-white copier and includes: an apparatus body 10 formed of an approximately cuboidal housing; and an automatic document feeder 11 disposed on the top of the apparatus body 10. The apparatus body 10 is a housing which houses various devices for use in subjecting a sheet to an image forming process.

The apparatus body 10 includes: a lower housing in an approximately cuboid shape; an upper housing disposed above the lower housing and having an approximately cuboid shape; and a connecting housing connecting the upper and lower housings. The lower housing houses an image forming section 20 configured to transfer a toner image to a sheet. The connecting housing houses a fixing section 30. The upper housing houses a scanner device 13 configured to optically read an image of an original document sheet. An intra-body space surrounded by the lower housing, the upper housing, and the connecting housing is an intra-body paper output section 14 capable of containing sheets on which images have been formed.

The connecting housing is disposed to the right side of the apparatus body 10 and has a first output port 141 opening to the intra-body space in order to output the sheet to the intra-body paper output section 14 and a second output port 142 for sheet output located above the first output port 141 and opening to the intra-body space. The bottom of the intra-body space is defined by an intra-body paper output tray 143. Sheets output through the first output port 141 are piled up on the intra-body paper output tray 143. A sub paper output tray 144 is mounted above the intra-body paper output tray 143. Sheets output through the second output port 142 are piled up on the sub paper output tray 144 or alternatively a sheet printed on one side is temporarily output on it so as to be then conveyed back to the image forming section 20 for the purpose of printing on the other side.

A paper feed cassette 15 capable of containing sheets to be subjected to an image forming process is detachably installed in a lower portion of the apparatus body 10. Furthermore, the right side surface 10R of the apparatus body 10 includes a side surface unit 17 capable of being pulled outwardly to the right by slide rail assemblies 4 to be described later. A conveyance unit PU is mounted on the side surface unit 17.

The image forming section 20 includes a photosensitive drum 21 and further includes a charger 22, an exposure unit 23, a developing device 24, a transfer roller 25, and a cleaning device 26 all of which are disposed around the photosensitive drum 21. The photosensitive drum 21 has a peripheral surface which can rotate about a rotation axis of the photosensitive drum 21 and on which an electrostatic latent image and a toner image can be formed. The charger 22 is configured to uniformly charge the peripheral surface of the photosensitive drum 21. The exposure unit 23 is configured to apply laser light to the peripheral surface of the photosensitive drum 21 in order to form an electrostatic latent image. The developing device 24 supplies toner to the peripheral surface of the photosensitive drum 21 in order to develop the electrostatic latent image formed on the photosensitive drum 21. The transfer roller 25 forms a transfer nip with the photosensitive drum 21 and is configured to transfer a toner image on the photosensitive drum 21 to a sheet. The cleaning device 26 cleans the peripheral surface of the photosensitive drum 21 having undergone the transfer of the toner image. A toner container 27 configured to supply toner to the developing device 24 is disposed adjacent to the developing device 24.

The fixing section 30 includes: a fixing roller 31 provided internally with a heat source; and a pressure roller 32 forming a fixing nip with the fixing roller 31. The fixing section 30 is configured to subject a sheet, to which a toner image has been transferred at the transfer nip, to a fixing process by applying heat and pressure to the sheet at the fixing nip. The sheet subjected to the fixing process is output through the first output port 141 or the second output port 142 toward the intra-body paper output section 14.

The apparatus body 10 is provided internally with a sheet conveyance path for conveying a sheet. The sheet conveyance path includes a main conveyance path P1 vertically extending from near the bottom of the apparatus body 10 to near the top thereof via the image forming section 20 and the fixing section 30. Near the downstream end of the main conveyance path P1, a first output conveyance path P2 is branched off from the main conveyance path P1 to guide the sheet to the first output port 141. Furthermore, a second output conveyance path P3 is connected to the most downstream end (upper end) of the main conveyance path P1 to guide the sheet to the second output port 142. Moreover, a reverse conveyance path P4 for, during double-sided printing, reversing the side of the sheet and conveying back the sheet is extended from the most downstream end of the main conveyance path P1 to near the upstream end thereof.

The paper feed cassette 15 is provided internally with a sheet container 151 in which a stack of sheets can be contained. A pick-up roller 152 and a paper feed roller pair 153 are disposed near the upper right of the sheet container 151. The pick-up roller 152 is configured to pick up the uppermost sheet of the stack of sheets one by one. The paper feed roller pair 153 is configured to feed the picked sheet to the upstream end of the main conveyance path P1. Furthermore, a manual feed tray 171 for manual paper feed is provided on the right side surface 10R of the apparatus body 10. A sheet placed on the manual feed tray 171 is fed to the upstream end of the main conveyance path P1 by a manual paper feed roller 172. A registration roller pair 154 is disposed in the main conveyance path P1 upstream of the image forming section 20. The registration roller 154 is configured to feed a sheet to the transfer nip with a predetermined timing.

The manual feed tray 171 and the manual paper feed roller 172 are also mounted on the side surface unit 17 (unit). The transfer roller 25, one roller of the registration roller pair 154, one roller of a roller pair for conveying a sheet, and so on are mounted on the conveyance unit PU. The inside surface of the conveyance unit PU is one of a pair of wall surfaces defining the main conveyance path P1, while the outside surface thereof is one of a pair of wall surfaces defining the reverse conveyance path P4.

In single-sided printing (image formation) of a sheet, a sheet is fed from the sheet container 151 or the manual feed tray 171 to the main conveyance path P1, then subjected, in the image forming section 20, to a transfer process for transferring a toner image thereto, and then subjected, in the fixing section 30, to a fixing process for fixing toner transferred thereto. Thereafter, the sheet is conveyed along the first output conveyance path P2 and then output through the first output port 141 onto the intra-body paper output tray 143. On the other hand, in double-sided printing of a sheet, one side of a sheet is first subjected to the transfer process and the fixing process and the sheet is then conveyed along the second output conveyance path P3 and then partly output through the second output port 142 onto the sub paper output tray 144. Thereafter, the sheet is conveyed back via the reverse conveyance path P4 and returned to near the upstream end of the main conveyance path P1. Then, the other side of the sheet is subjected to the transfer process and the fixing process and the sheet is conveyed along the first output conveyance path P2 and then output through the first output port 141 onto the intra-body paper output tray 143.

Figure 2:
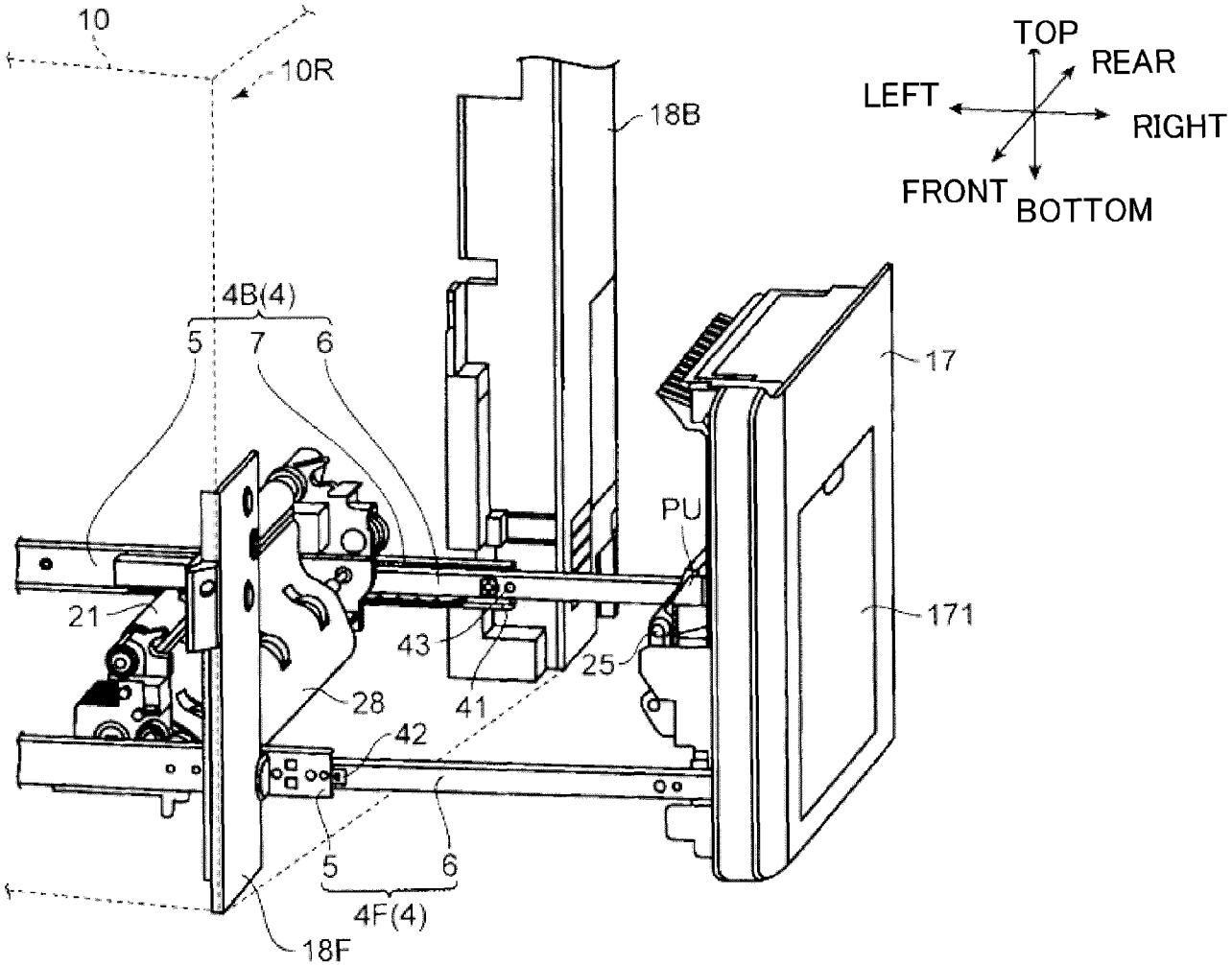
FIG. 2 is a perspective view showing a state where a conveyance unit is pulled outwardly from an apparatus body with the aid of slide rail assemblies.

FIG. 2 is a perspective view showing a state where the conveyance unit PU, together with the side surface unit 17, are pulled outwardly from the right side surface 10R of the apparatus body 10 with the aid of the slide rail assemblies 4. FIG. 2 shows an example where a front slide rail assembly 4F and a rear slide rail assembly 4B are disposed as slide rail assemblies 4, wherein the front slide rail assembly 4F is extended in the right-and-left direction in a front-side lower portion of the apparatus body 10 and the rear slide rail assembly 4B is extended in the right-and-left direction in a rear-side lower portion of the apparatus body 10. The front slide rail assembly 4F and the rear slide rail assembly 4B have the same structure.

The side surface unit 17 is normally in a fitted state where it is in close contact with a front frame 18F and a rear frame 18B of the apparatus body 10 and, when pulled outwardly, it is spaced apart from the frames 18F and 18B to the right in FIG. 2. When the side surface unit 17 is in the fitted state, a portion of the main conveyance path P1 is defined by the right side surface of an image forming unit 28 including the photosensitive drum 21 and the inside surface (left side surface) of the conveyance unit PU. On the other hand, when the side surface unit 17 is pulled outwardly, the main conveyance path P1 is opened to the outside, which enables clearing of sheet jam or replacement or maintenance of the image forming unit 28 or other units.

Each slide rail assembly 4 (4F, 4B) includes: a fixed rail 5 mounted to the apparatus body 10; a movable rail 6 mounted to the side surface unit 17; and a ball retainer 7 (holding member) slidably assembled to the fixed rail 5 and holding the movable rail 6 to allow sliding movement of the movable rail 6. The fixed rail 5 has a slightly smaller dimension in the longitudinal direction thereof (the right-and-left direction) than the width of the apparatus body 10 in the right-and-left direction thereof and is fixed to a lower portion of a structural framing assembly (not shown) forming the framework of the apparatus body 10. More specifically, the fixed rail 5 of the front slide rail assembly 4F is fixed to a front portion of the structural framing assembly and the fixed rail 5 of the rear slide rail assembly 4B is fixed to a rear portion of the structural framing assembly.

The movable rail 6 has substantially the same longitudinal dimension as the fixed rail 5. The right end of the movable rail 6 is fixed to the side surface unit 17. The movable rail 6 is changeable between a first state where the movable rail 6 is retracted in the fixed rail 5 and a second state where the movable rail 6 partly extends out from the fixed rail 5 by sliding to the right (in a single direction) along the fixed rail 5. The ball retainer 7 is slidable in the right-and-left direction within the fixed rail 5 by an approximately half of the amount of sliding movement of the movable rail 6. FIG. 2 shows a state where the movable rail 6 is in the second state and is maximally extended out from the fixed rail 5. This corresponds to a state where the side surface unit 17 is pulled outwardly to the maximum from the apparatus body 10.

Although FIG. 2 shows a state where the side surface unit 17 is pulled outwardly to the maximum from the apparatus body 10 as the side surface unit 17 and the apparatus body 10 are held engaged, the side surface unit 17 can be removed from the apparatus body 10. In this case, when the movable rail 6 is fully removed from the fixed rail 5 (in a third state), the side surface unit 17 and the apparatus body 10 are disengaged from each other.

Figure 3:
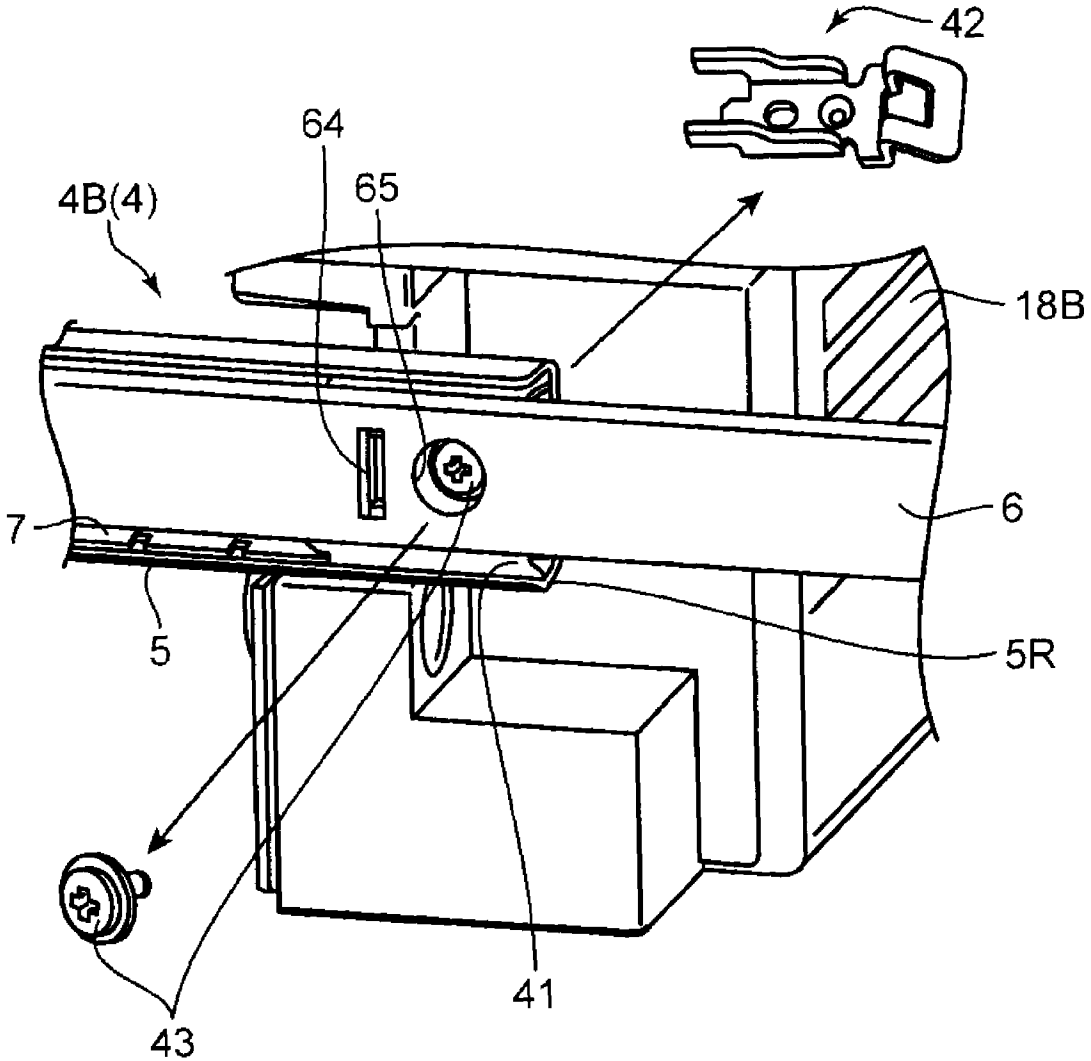
FIG. 3 is a perspective view showing a relevant portion of the slide rail assembly.
Figure 4:
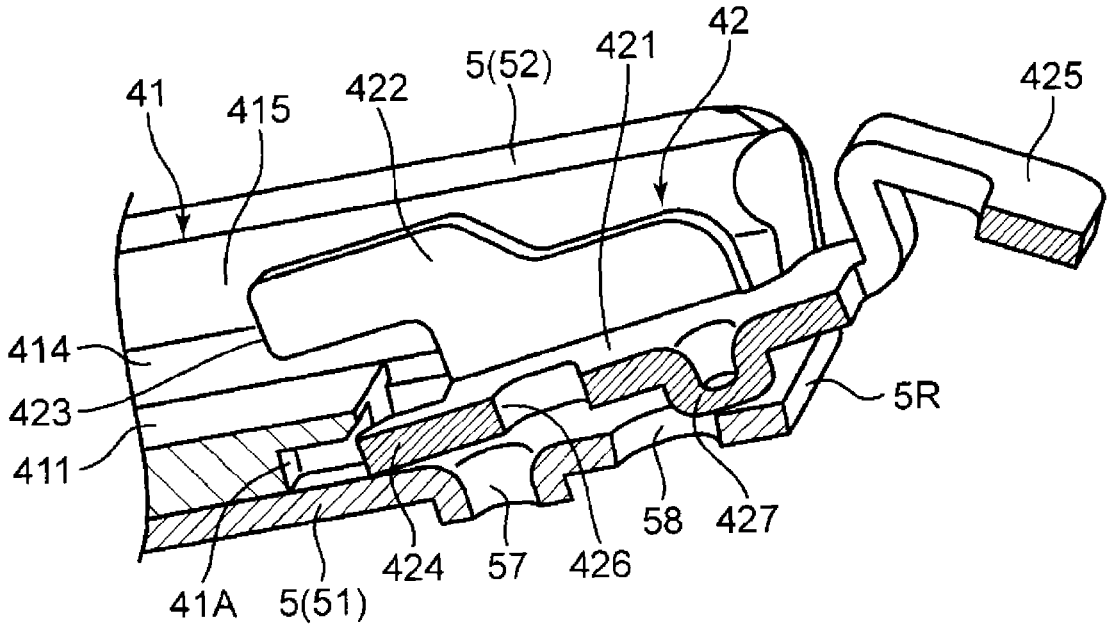
FIG. 4 is a perspective view showing a state where a restricting member is assembled.

FIG. 3 is a perspective view showing a relevant portion of the slide rail assembly 4 (4B). A stopper 41 assembled to the right end of the fixed rail 5 restricts the ball retainer 7 from slipping out of the fixed rail 5. Furthermore, a restricting member 42 assembled near the right end of the fixed rail 5 restricts the movable rail 6 from slipping out of the fixed rail 5. The restricting member 42 is fixed to the fixed rail 5 by a screw 43. FIG. 4 is a perspective view showing a state where the stopper 41 and the restricting member 42 are assembled to the fixed rail 5. Specific configurations of these members will be described in detail later.

Figure 5:
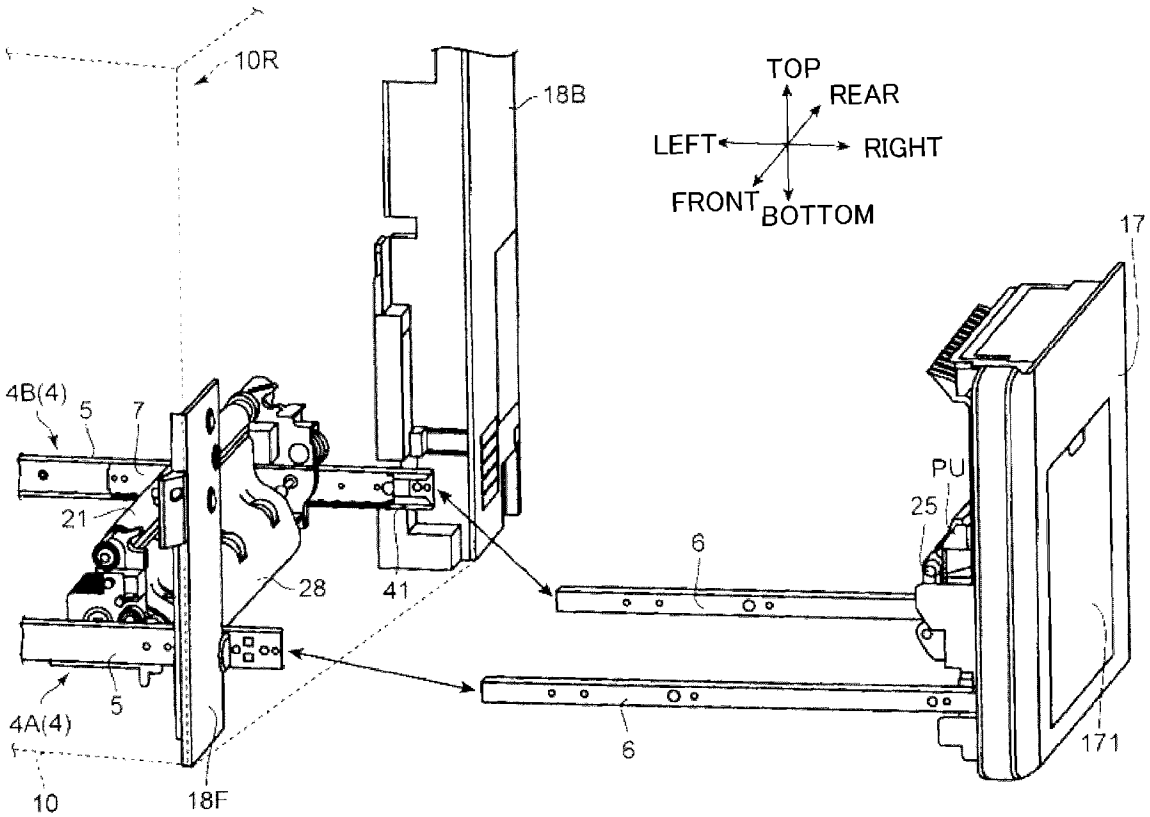
FIG. 5 is a perspective view showing a state where the conveyance unit is removed from the apparatus body.

FIG. 5 is a perspective view showing a state where the side surface unit 17 is removed from the apparatus body 10. The user can slide off the movable rail 6 from the fixed rail 5 (or rather the ball retainer 7) by loosening the screw 43 and removing the restricting member 42. Thus, with the side surface unit 17 fully separated from the apparatus body 10 as shown in FIG. 5, the user can perform maintenance work or part replacement work. After the end of the work, the user will insert the left end of the movable rail 6 into the right end of the fixed rail 5 (or rather the ball retainer 7) and mount the restricting member 42 to the fixed rail 5. However, the ball retainer 7 is free to move relative to the fixed rail 5. Therefore, the ball retainer 7 is often located to the left of FIG. 5 (behind an apparatus body plane from which the side surface unit 17 is pulled outwardly). In this case, the movable rail 6 may not be able to be easily reassembled to the ball retainer 7.

In view of the above, the slide rail assembly 4 of this embodiment includes a lever member 8 (fixing part) configured to, when the movable rail 6 is fully removed from the fixed rail 5 (in the third state), lock the ball retainer 7 against sliding movement relative to the fixed rail 5 and, when the movable rail 6 is engaged with the fixed rail 5 (in the first and second states), release the locking of the ball retainer 7. A detailed description will be given below of the slide rail assembly 4 according to this embodiment with sequential reference to FIGS. 6 to 18.

Figure 6:
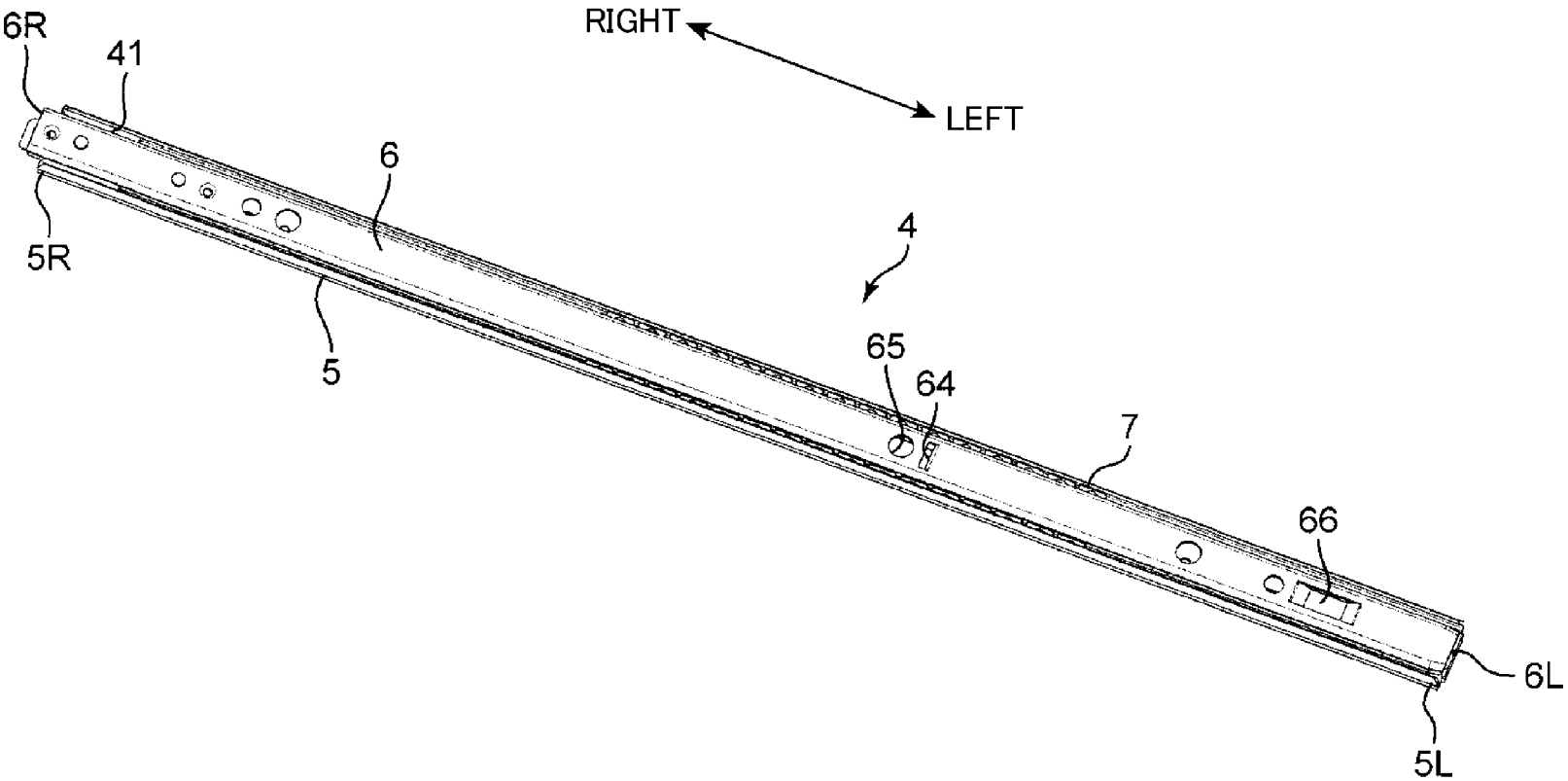
FIG. 6 is a perspective view of the slide rail assembly, showing a state where a movable rail is fully retracted in a fixed rail.

FIG. 6 is a perspective view of the slide rail assembly 4, showing a state where the movable rail 6 is fully retracted in the fixed rail 5 (in the first state). FIG. 7 is also perspective views of the slide rail assembly 4, in which FIG. 7A shows a state where the movable rail 6 is slid out about a half of its slidable range from the fixed rail 5 (in a form of the second state) and FIG. 7B shows a state where the movable rail 6 is slid out maximally from the fixed rail 5 (in another form of the second state).

The state of FIG. 6 corresponds to the fitted state where the side surface unit 17 is fitted to the right side surface 10R of the apparatus body 10. Since, as described above, the fixed rail 5 and the movable rail 6 have substantially the same longitudinal dimension, the left ends 5L and 6L of the fixed rail 6 and movable rail 6 are located at substantially the same position and the right ends 5R and 6R of them are also located at substantially the same position. The ball retainer 7 holding the movable rail 6 is located at the leftmost end of the movable range within the fixed rail 5.

Figure 7A:
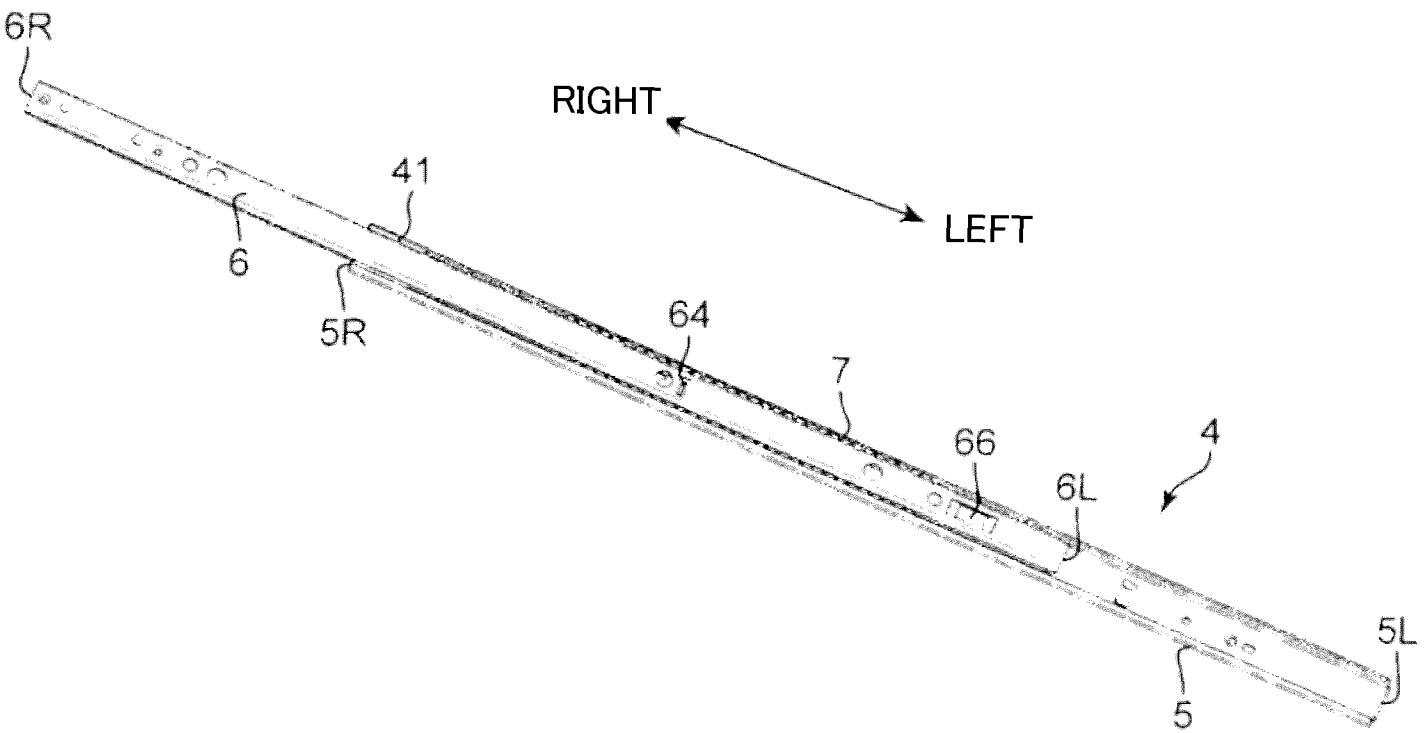
FIG. 7A shows a state where the movable rail is slid out about a half from the fixed rail and FIG. 7B shows a state where the movable rail is slid out maximally from the fixed rail.

In the state of FIG. 7A, the movable rail 6 has slidingly moved relative to the fixed rail 5 so that the right end 6R of the movable rail 6 projects to the right beyond the right end 5R of the fixed rail 5. This corresponds to a state where the side surface unit 17 has been pulled outwardly to a certain degree from the right side surface 10R of the apparatus body 10. The ball retainer 7 has moved to the right to about a half of the amount of sliding movement relative to the fixed rail 5.

Figure 7B:
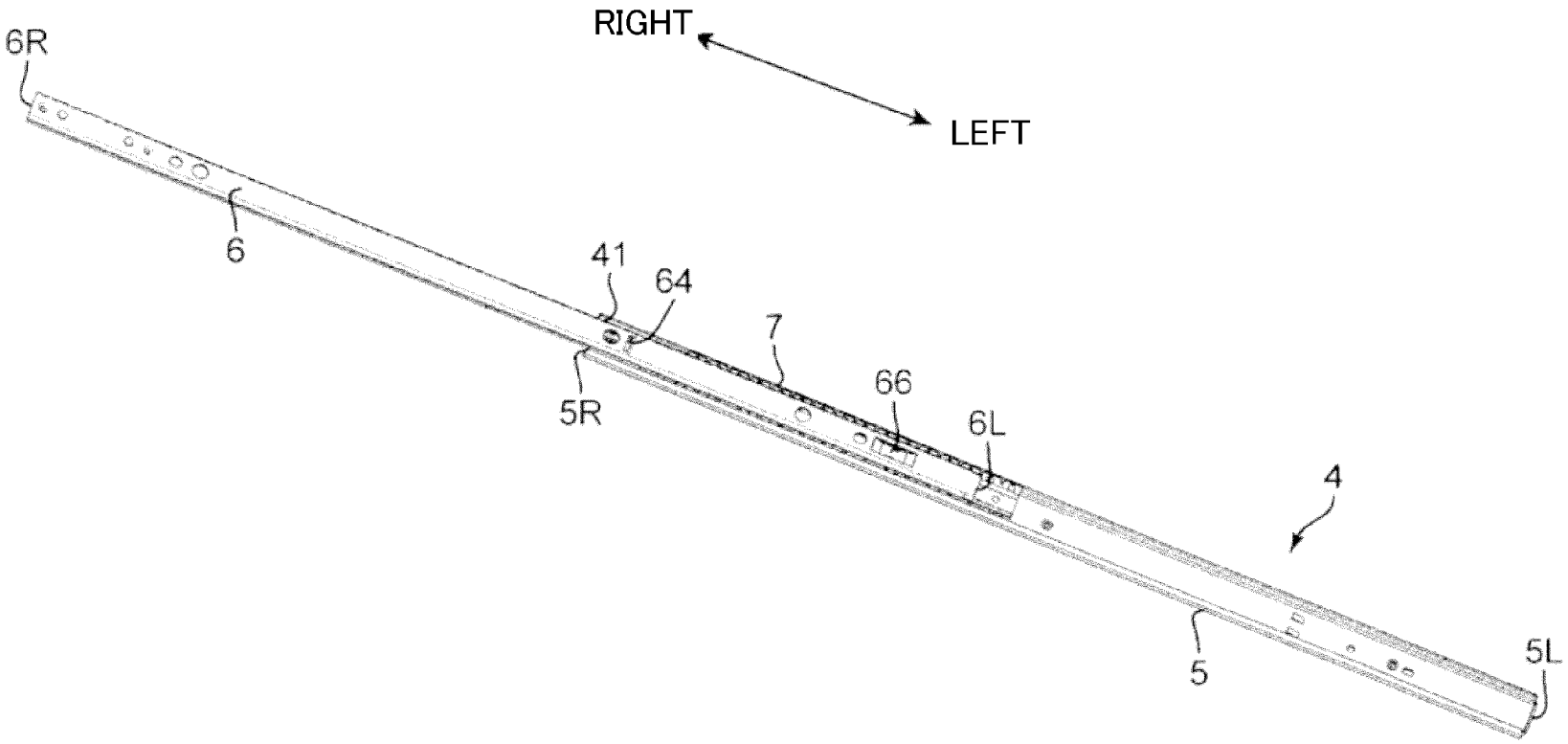

The state of FIG. 7B corresponds to a state where, as shown in FIG. 2, the side surface unit 17 has been pulled maximally to the right from the right side surface 10R of the apparatus body 10. In this state, the movable rail 6 has slidingly moved relative to the fixed rail 5 so that the right end 6R of the movable rail 6 projects maximally to the right beyond the right end 5R of the fixed rail 5. In this state, an after-mentioned bent portion 64 of the movable rail 6 abuts against the restricting member 42. Furthermore, in this state, the ball retainer 7 is located at the rightmost end of the movable range within the fixed rail 5 and abuts against the stopper 41.

Figure 8A:
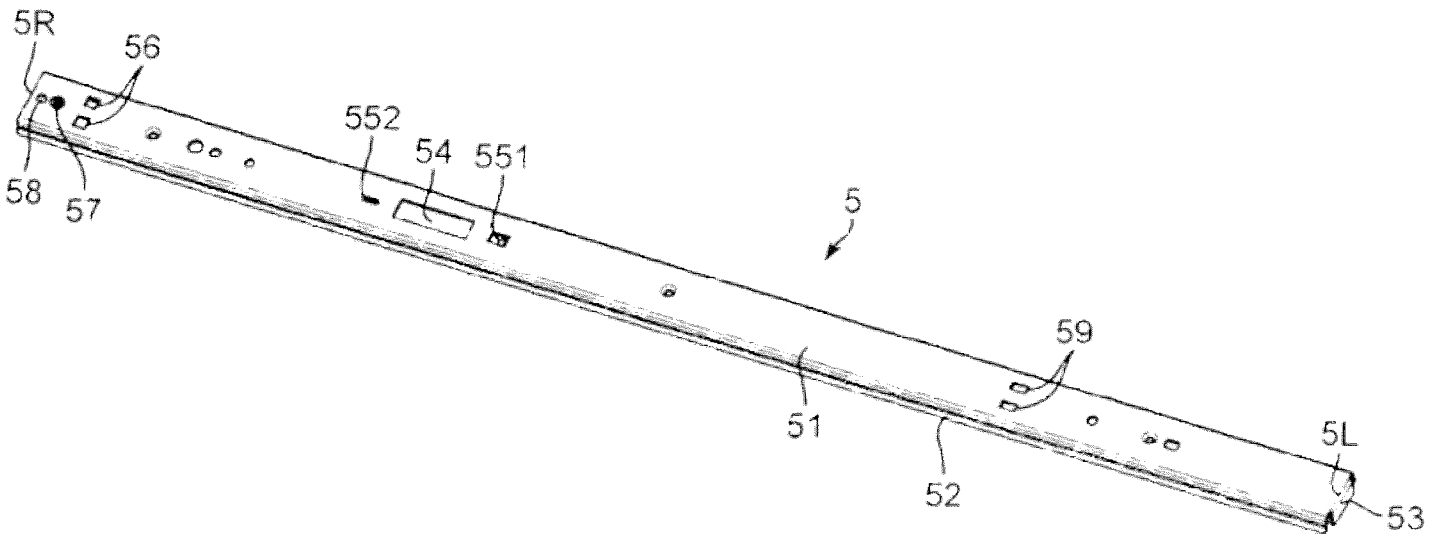
FIGS. 8A and 8B are perspective views of the fixed rail and FIG. 8C is a side view thereof.
Figure 8B:
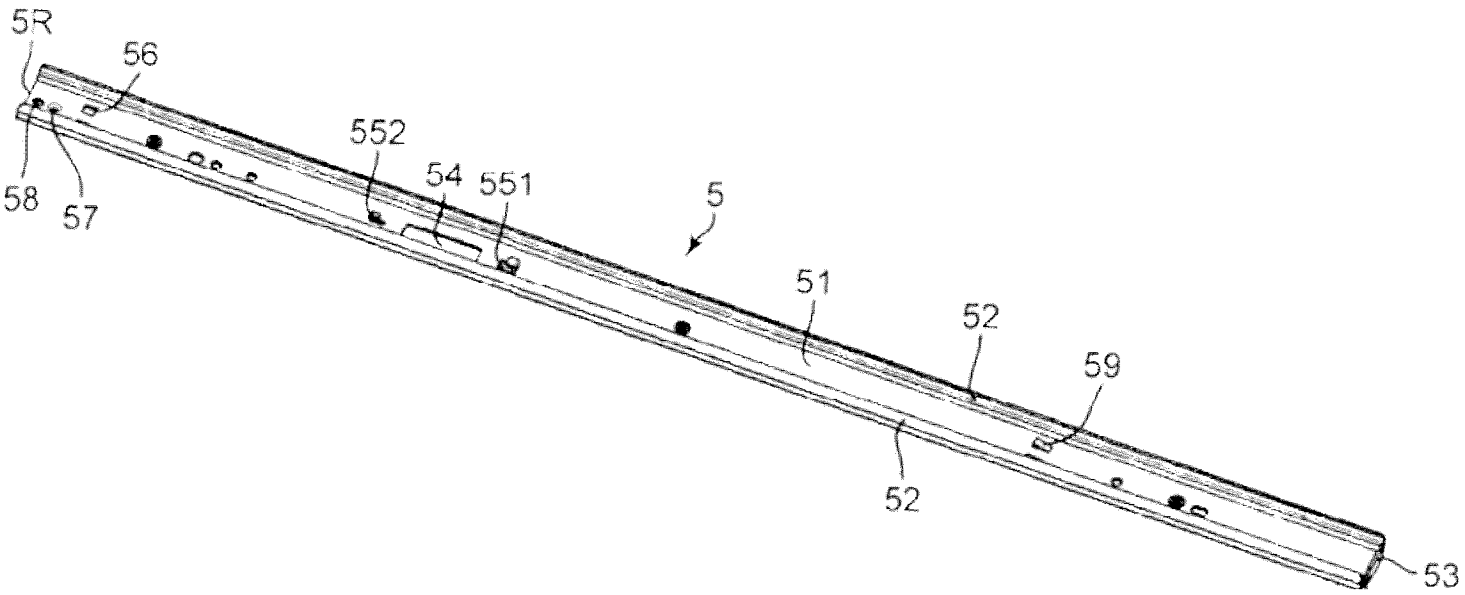
Figure 8C:
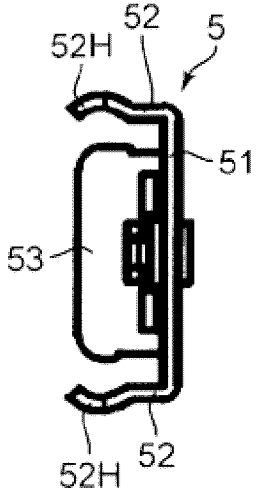

Hereinafter, a detailed description will be given of each of the component members of the slide rail assembly 4. FIG. 8A is a perspective view of the fixed rail 5 as viewed from its back surface (the surface thereof to be fixed to the structural frame assembly), FIG. 8B is a perspective view of the fixed rail 5 as viewed from its front surface, and FIG. 8C is a side view of the fixed rail 5 as viewed from the right. The fixed rail 5 is formed of a metal plate material and includes a band-like base plate 51 extending in a single direction (the right-and-left direction) and a pair of guiding portions 52 upstanding from both side edges of the base plate 51 and extending in the single direction.

The guiding portions 52 serve to guide the sliding movement of the movable rail 6 through the ball retainer 7. The distance between the pair of guiding portions 52 is greater not only than the width of the movable rail 6 but also than the width of the ball retainer 7. The height of the guiding portions 52 is substantially equal to or slightly greater than the heights of the movable rail 6 and the ball retainer 7. Therefore, the movable rail 6 and the ball retainer 7 can be generally set in a U-shaped space formed by the base plate 51 and the pair of guiding portions 52.

The guiding portions 52 are portions formed by bending both side edge portions of the base plate 51. As shown in FIG. 8C, each guiding portion 52 includes a curved portion 52H which is an outwardly bulged, distal end portion joining a root end portion which is a bent portion perpendicular to the base plate 51. The curved portions 52H each provided in the pair of guiding portions 52 face each other at their arcuate inside surfaces. Members directly guided by the arcuate inside surfaces of the curved portions 52H are balls 7B (see FIG. 10) of the ball retainer 7. Therefore, the arcuate inside surface of each curved portion 52H has a curved surface conforming to the outside diameter of the balls 7B.

The left end 5L of the fixed rail 5 is provided with a terminal stopper 53. The terminal stopper 53 is a portion formed by bending the left end of the base plate 51 at right angle in the same direction as the guiding portions 52. The abutment of the left end 6L of the movable rail 6 against the terminal stopper 53 prevents the movable rail 6 from sliding leftward out of the fixed rail 5. On the other hand, at the right end 5R of the fixed rail 5, no obstacle exists between the pair of guiding portions 52. Therefore, at the right end 5R, the removed movable rail 6 can be freely inserted into the fixed rail 5 and can be free to extend out from and retract into the fixed rail 5.

Slightly rightward of the middle of the base plate 51 in the right-and-left direction, a rectangular opening 54, a first turned-out portion 551, and a second turned-out portion 552 are disposed. The first and second turned-out portions 551, 552 are disposed with the opening 54 in between. The opening 54 functions as an escape hole allowing free elastic deformation of the lever member 8 to be described later and the first and second turned-out portions 551, 552 are hooked projections for holding right and left edges of the lever member 8.

The base plate 51 is provided, near the right end 5R of the fixed rail 5, with two fixing windows 56, a screw hole 57, and a positioning hole 58. The fixing windows 56 are openings for positioning and fixing the stopper 41 to the base plate 51. Referring also to FIGS. 3 and 4, the screw hole 57 is a hole for fixing the restricting member 42 to the base plate 51 by the screw 43 and the positioning hole 58 is a hole for positioning the restricting member 42 to the base plate 51. At a position of the fixed rail 5 closer to the left end 5L than the longitudinal middle of the fixed rail 5, a pair of third turned-out portions 59 are projected from the base plate 51. The third turned-out portions 59 are projections for preventing the ball retainer 7 from sliding leftward out of the fixed rail 5.

Figure 9A:
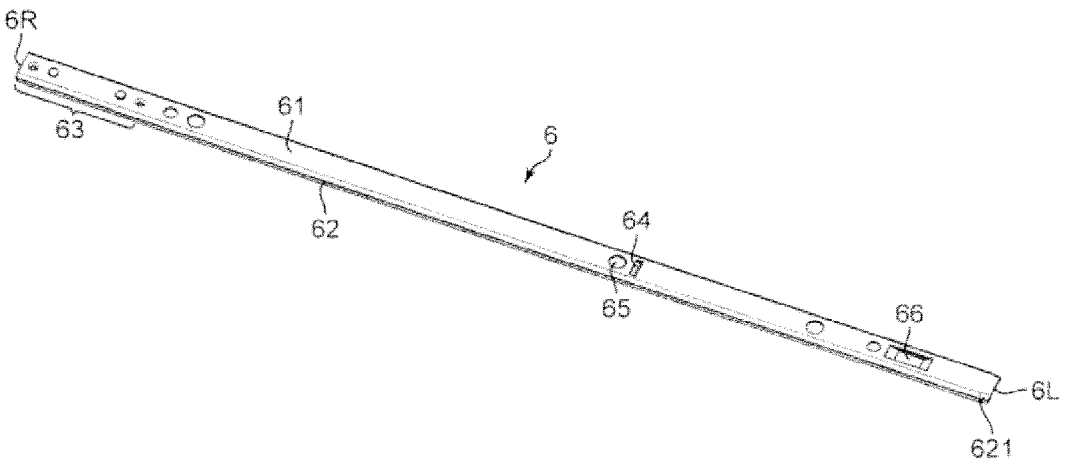
FIGS. 9A and 9B are perspective views of the movable rail and FIG. 9C is a side view thereof.
Figure 9B:
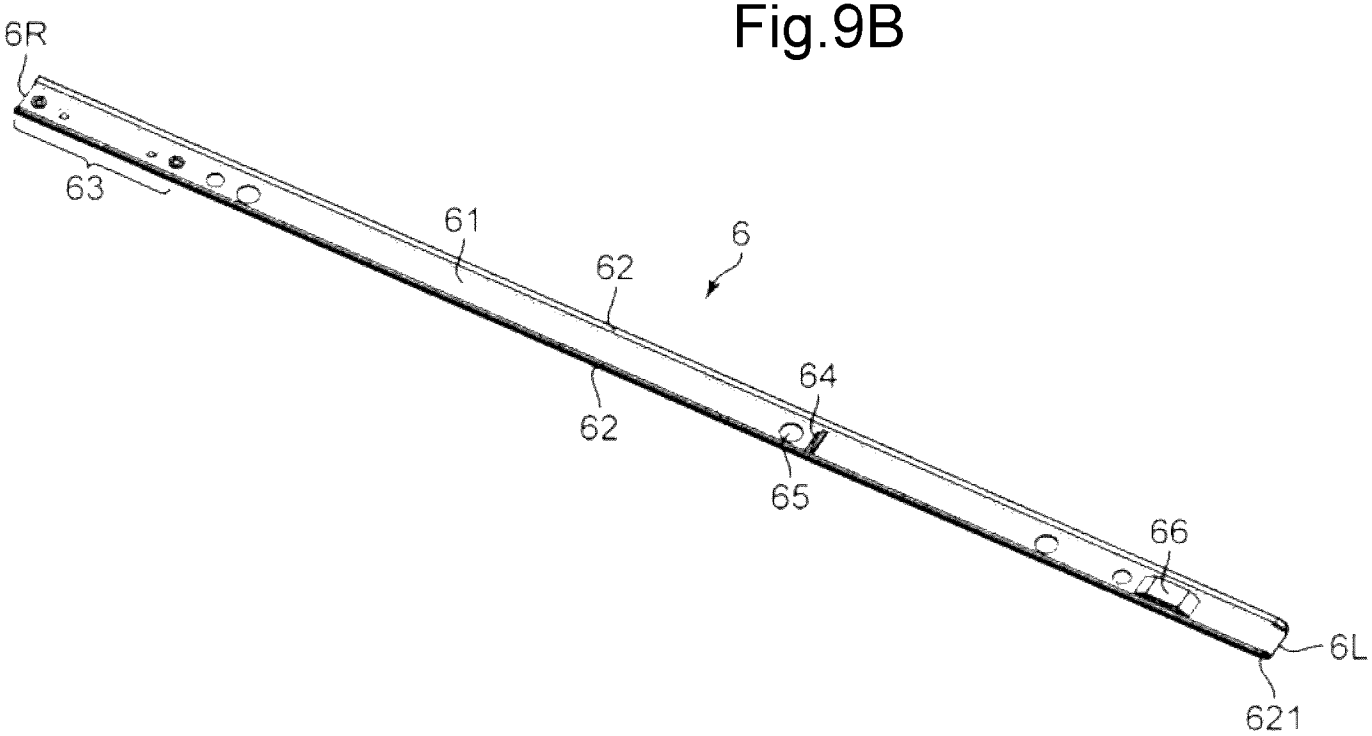
Figure 9C:
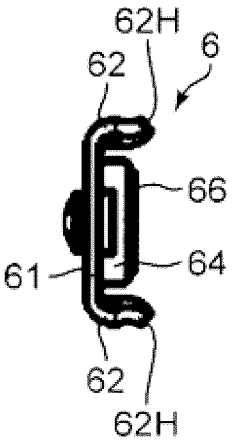

FIG. 9A is a perspective view of the movable rail 6 as viewed from its back surface (the opposite surface to the surface facing the fixed rail 5), FIG. 9B is a perspective view of the movable rail 6 as viewed from its front surface, and FIG. 9C is a side view of the movable rail 6 as viewed from the right. The movable rail 6 is formed of a metal plate material and includes a band-like base plate 61 extending in a single direction (the right-and-left direction) and a pair of guided portions 62 upstanding from both side edges of the base plate 61 and extending in the single direction.

The guided portions 62 are portions to be guided by the guiding portions 52 of the fixed rail 5 though the ball retainer 7. The guided portions 62 are portions formed by bending both side edge portions of the base plate 61. As shown in FIG. 9C, each guided portion 62 includes a curved portion 62H which is an outwardly recurvate, distal end portion joining a root end portion which is a bent portion perpendicular to the base plate 61. The arcuate outside surfaces of the curved portions 62H are brought into sliding contact with ball sockets 73 (see FIG. 10) of the ball retainer 7. Furthermore, the distal ends of the curved portions 62H enter engagement spaces 73H (see FIG. 10C) located behind the ball sockets 73, so that the movable rail 6 and the ball retainer 7 are engaged with each other (fitted together). The left end 6L of the movable rail 6 is provided with a tapered portion 621 in which the pair of guided portions 62 gradually reduce the distance between them. The provision of the tapered portion 621 facilitates the user's work of inserting the fully removed movable rail 6 into the ball retainer 7.

A region of the movable rail 6 near the right end 6R is a fixing region 63 for fixing the movable rail 6 to the side surface unit 17. The movable rail 6 is fixed to the side surface unit 17 using screw holes provided in the fixing region 63 and unshown screws.

The base plate 61 is provided, slightly leftward of the middle thereof in the right-and-left direction, with a bent portion 64 for preventing the movable rail 6 from sliding rightward out of the fixed rail 5. The bent portion 64 is a projection formed by bending a portion of the base plate 61 in the same direction as the guided portions 62 and is raised between the pair of guided portions 62 as shown in FIG. 9C. The bent portion 64 interferes with abutment portions 423 (see FIG. 12) of the restricting member 42 to restrict rightward sliding movement of the movable rail 6 relative to the fixed rail 5. Specifically, when the movable rail 6 is slid out maximally rightward from the fixed rail 5, the bent portion 64 abuts against the abutment portions 423 to prevent the movable rail 6 from sliding out of the fixed rail 5. Referring also to FIG. 3, a circular opening 65 is formed immediately to the right of the bent portion 64. The user can insert a screw driver through the opening 65 to install or remove the screw 43.

The base plate 61 is provided, near the left end 6L of the movable rail 6, with a pressing portion 66 raised by subjecting a portion of the base plate 61 to drawing. The rising direction of the pressing portion 66 is the same as the upstanding direction of the guided portions 62. The pressing portion 66 is a portion for pressing the after-mentioned lever member 8. By the pressing, the lever member 8 can be changed from an interfering position, in which the ball retainer 7 is locked, to a retreated position, in which the locking of the ball retainer 7 is released. This point will be described in detail later.

Figure 10A:
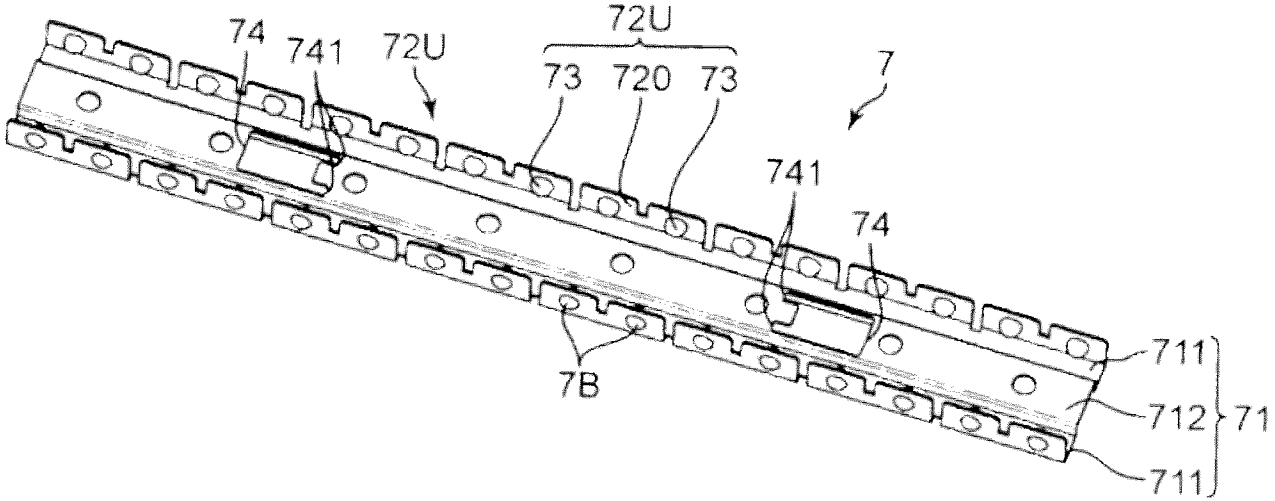
FIGS. 10A and 10B are perspective views of a ball retainer and FIG. 10C is a side view thereof.
Figure 10B:
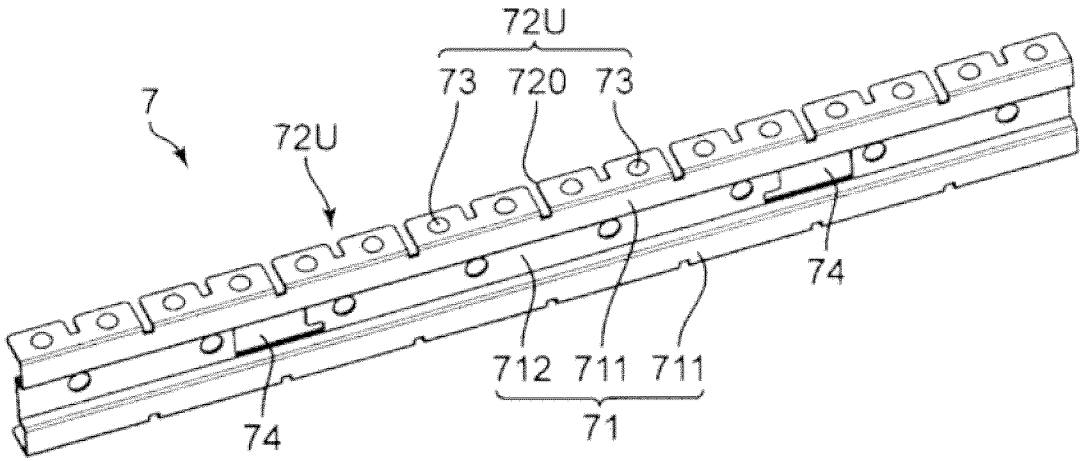
Figure 10C:
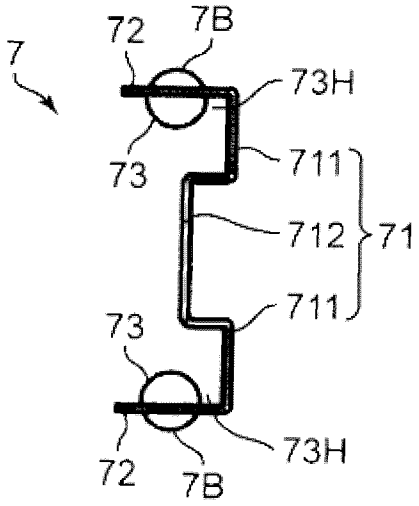

FIG. 10A is a perspective view of the ball retainer 7 as viewed from its front surface (the surface facing the movable rail 6), FIG. 10B is a perspective view of the ball retainer 7 as viewed from its back surface, and FIG. 10C is a side view of the ball retainer 7. The ball retainer 7 is placed between the fixed rail 5 and the movable rail 6 and holds a plurality of balls 7B capable of rolling along the guiding portions 52 of the fixed rail 5. The ball retainer 7 is a member having a length (dimension in the right-and-left direction) of approximately one third of the lengths of the fixed rail 5 and the movable rail 6 and includes a bottom plate frame 71 and side plate frames 72 upstanding from both side edges of the bottom plate frame 71.

The bottom plate frame 71 includes a pair of base portions 711 and a rib portion 712 located above the level of the base portions 711. The bottom plate frame 71 has a shape in which the rib portion 712 is disposed between the pair of band-like base portions 711 parallel to each other and rises from the base portions 711. A space is formed on the back side of the rib portion 712.

The pair of side plate frames 72 are portions facing the guiding portions 52 of the fixed rail 5 and upstand vertically from the respective side edges of the base portions 711. In this embodiment, an example is shown where each side plate frame 72 is composed of a plurality of side plate pieces 72U arranged in a line in the longitudinal direction of the ball retainer 7. Each side plate piece 72U includes a bent piece 720 and two ball sockets 73. The ball sockets 73 are hemispherical concavities formed by inwardly indenting the outside surfaces of the bent pieces 720 by drawing. Each ball socket 73 accommodates a ball 7B formed of a steel ball to allow the ball 7B to roll therein. Each ball 7B is caught between the ball socket 73 and the arcuate inside surface of an associated one of the curved portions 52H provided in the guiding portions 52 of the fixed rail 5. While the ball retainer 7 slidingly moves on the fixed rail 5, the balls 7B held by the ball sockets 73 roll on the arcuate inside surfaces of the curved portions 52H to ensure smooth sliding movement of the ball retainer 7.

Each ball socket 73 is provided in or near the middle of the side plate frame 72 (bent piece 720) in the height direction. Thus, as shown in FIG. 10C, an engagement space 73H capable of accommodating a member not exceeding a given thickness is formed between each row of ball sockets 73 and the neighboring base portion 711. As described above, the engagement space 73H can accommodate the distal end of the curved portion 62H provided in the associated guided portion 62 of the movable rail 6.

The rib portion 712 is provided with window portions 74 which are rectangular openings. The window portions 74 are openings through which a pressure receiving portion 84 (see FIGS. 14 and 15) of the after-mentioned lever member 8 can project. Each window portion 74 is provided continuously with grooves 741 into which tapered portions 842 of the pressure receiving portion 84 can fit. In this embodiment, an example is shown where two window portions 74 are provided in the rib portion 712. In practice, however, either one of the window portions 74 is used. The reason for this is that in assembling the ball retainer 7 to the fixed rail 5, the user can easily assemble the ball retainer 7 without considering its orientation.

One of the longitudinal ends of the ball retainer 7 is configured to abut against the stopper 41 assembled to the fixed rail 5 and the other end thereof is configured to abut against the third turned-out portions 59 of the base plate 51. Although in this manner the range of movement of the ball retainer 7 is restricted by the stopper 41 and the third turned-out portions 59, the ball retainer 7 can slidingly move along the guiding portions 52 in the range of longitudinal extension of the guiding portions 52 of the fixed rail 5. Furthermore, the ball retainer 7 holds the movable rail 6 to allow sliding movement of the movable rail 6 with the guided portions 62 of the movable rail 6 engaged in the engagement spaces 73H.

The height of the space on the back side of the rib portion 712 is set higher than those of the first and second turned-out portions 551, 552 upstanding from the base plate 51 of the fixed rail 5. Since the first and second turned-out portions 551, 552 project on the widthwise middle of the base plate 51, they do not interfere with the rib portion 712 during sliding movement of the ball retainer 7. On the other hand, the pair of third turned-out portions 59 project not on the widthwise middle but near the widthwise ends of the base plate 51. Therefore, the edges of the pair of base portions 711 interfere with the pair of third turned-out portions 59.

Figure 11B:
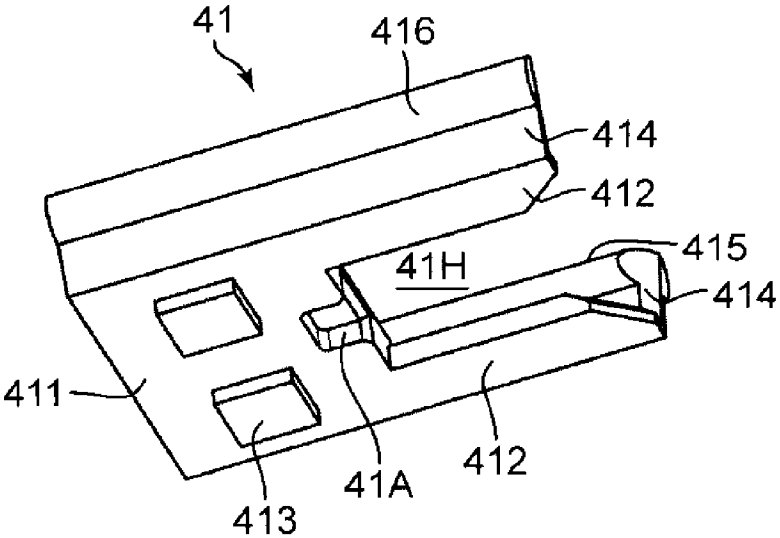
FIGS. 11A and 11B are perspective views of a stopper.
Figure 11A:
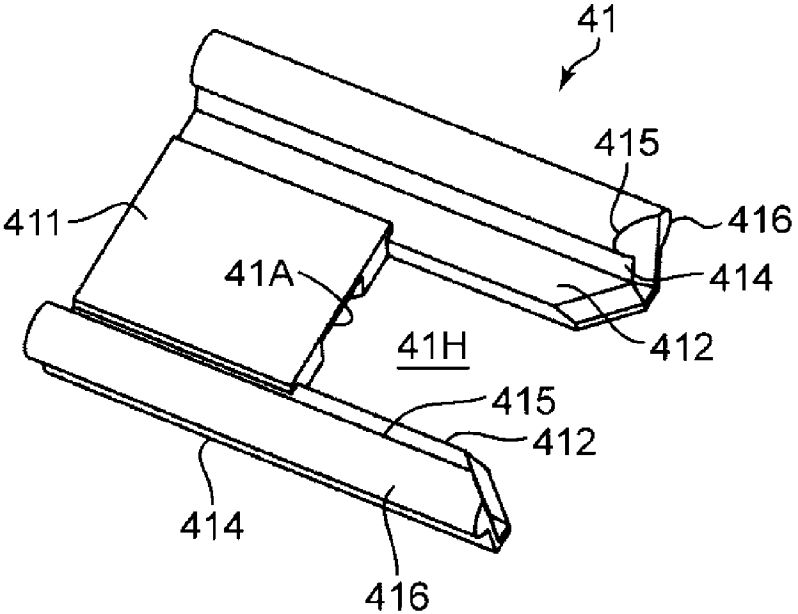

FIG. 11A is a perspective view of the stopper 41 and FIG. 11B is a perspective view of the stopper 41 as viewed from a different point of view. The stopper 41 is a member attached to the right end 5R of the fixed rail 5 to restrict the ball retainer 7 from slipping out of the fixed rail 5. The stopper 41 includes an approximately square plate member 411 in surface contact with the base plate 51 of the fixed rail 5. Extensions 412 are extended from both sides of the plate member 411. A receiving recess 41H is formed between the extensions 412 to receive the restricting member 42 to be described below.

A pair of positioning projections 413 in a cuboidal shape are projected from the back surface (the surface appearing in FIG. 11B) of the plate member 411. The pair of positioning projections 413 are fitted into the two fixing windows 56, respectively, pierced in the base plate 51. Furthermore, a recessed groove 41A is formed in the end surface of the plate member 411 facing the receiving recess 41H. The recessed groove 41A is configured to receive a lug 424 of the restricting member 42.

Side plates 414 upstand from the outside edges of the extensions 412. An inside arcuate ridge 415 and an outside arcuate ridge 416 are provided at the distal end of each side plate 414. The outside arcuate ridge 416 is configured to fit in the arcuate inside surface of an associated one of the curved portions 52H provided in the guiding portions 52 of the fixed rail 5. On the other hand, the inside arcuate ridge 415 has a curved surface substantially conforming to the arcuate outside surface of the curved portion 62H provided in each of the guided portions 62 of the movable rail 6. When the stopper 41 is attached to the fixed rail 5, these arcuate ridges 415, 416 fill in gaps, each between the adjacent curved portions 52H and 62H of the fixed rail 5 and the movable rail 6. Thus, the edge of the ball retainer 7 abuts against the side plates 414, so that the ball retainer 7 is restricted from slipping rightward out of the fixed rail 5.

Figure 12B:
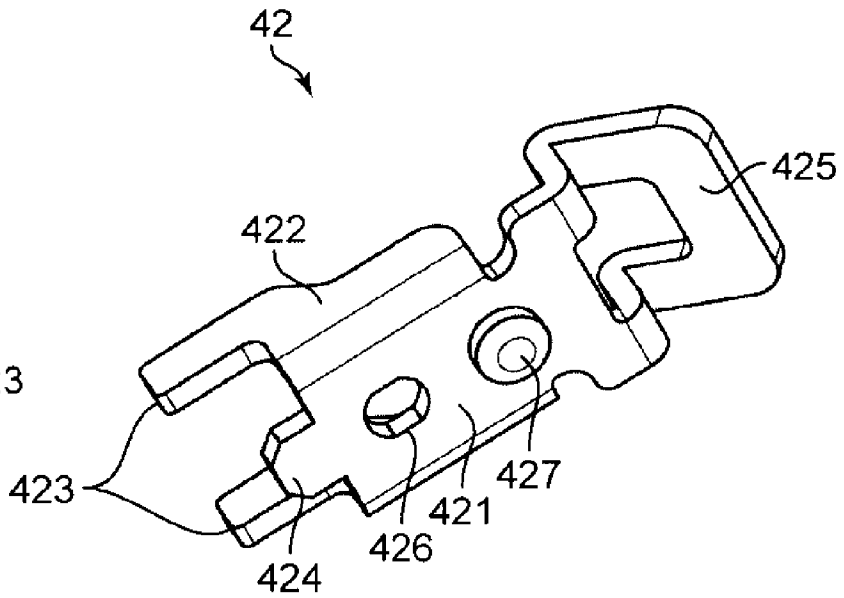
FIGS. 12A and 12B are perspective views of the restricting member.
Figure 12A:
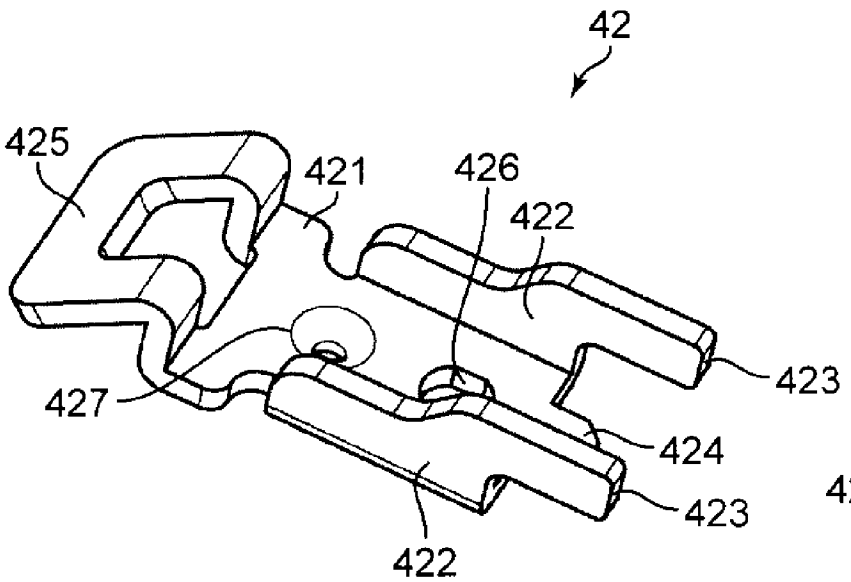

FIG. 12A is a perspective view of the restricting member 42 and FIG. 12B is a perspective view of the restricting member 42 as viewed from a different point of view. The restricting member 42 is a member attached to the right end 5R of the fixed rail 5 to restrict the movable rail 6 from slipping out of the fixed rail 5. Referring also to FIG. 4, the restricting member 42 includes a plate member 421 in surface contact with the base plate 51 of the fixed rail 5. Side plates 422 upstand from the outside edges of the plate member 421. The side plates 422 have their respective portions extending beyond the plate member 421 and the distal ends of the extending portions are abutment portions 423. By the interference of the abutment portions 423 with the bent portion 64 of the movable rail 6, the movable rail 6 is restricted from slipping rightward out of the fixed rail 5.

The plate member 421 includes a lug 424 projecting from one end thereof. As described above, the lug 421 is fitted into the recessed groove 41A of the stopper 41. The other end of the plate member 421 is provided continuously with a grip portion 425 which the user can grip, for example, in assembling the restricting member 42 to the fixed rail 5. The plate member 421 further includes: a slot 426 through which the screw 43 passes in fixing the restricting member 42 to the base plate 51 with the screw 43; and a boss 427 which can fit into the positioning hole 58 of the base plate 51.

In removing the restricting member 42 from the fixed rail 5, the user loosens and removes the screw 43, picks up the grip portion 425 to take the boss 427 out of the positioning hole 58, and then pulls the grip portion 425 to the right (this state is shown in FIG. 4). On the contrary, in attaching the restricting member 42 to the fixed rail 5, the user inserts the restricting member 42 obliquely into the right end 5R of the fixed rail 5. In doing so, the user fits the boss 427 into the positioning hole 58 while fitting the lug 424 into the recessed groove 41A. Thus, the slot 426 is aligned with the screw hole 57 of the fixed rail 5. Thereafter, the user inserts the screw 43 through the opening 65 of the movable rail 6 into the slot 426 and tightens the screw 43.

The slide rail assembly 4 having the above structure further includes the lever member 8. The lever member 8 is configured to, when the movable rail 6 is fully removed from the fixed rail 5 (in the third state, see FIG. 5), lock the ball retainer 7 against sliding movement relative to the fixed rail 5 and, when the movable rail 6 is engaged with the fixed rail 5 (in the first and second states, see FIG. 2), release the locking of the ball retainer 7.

Figure 13A:
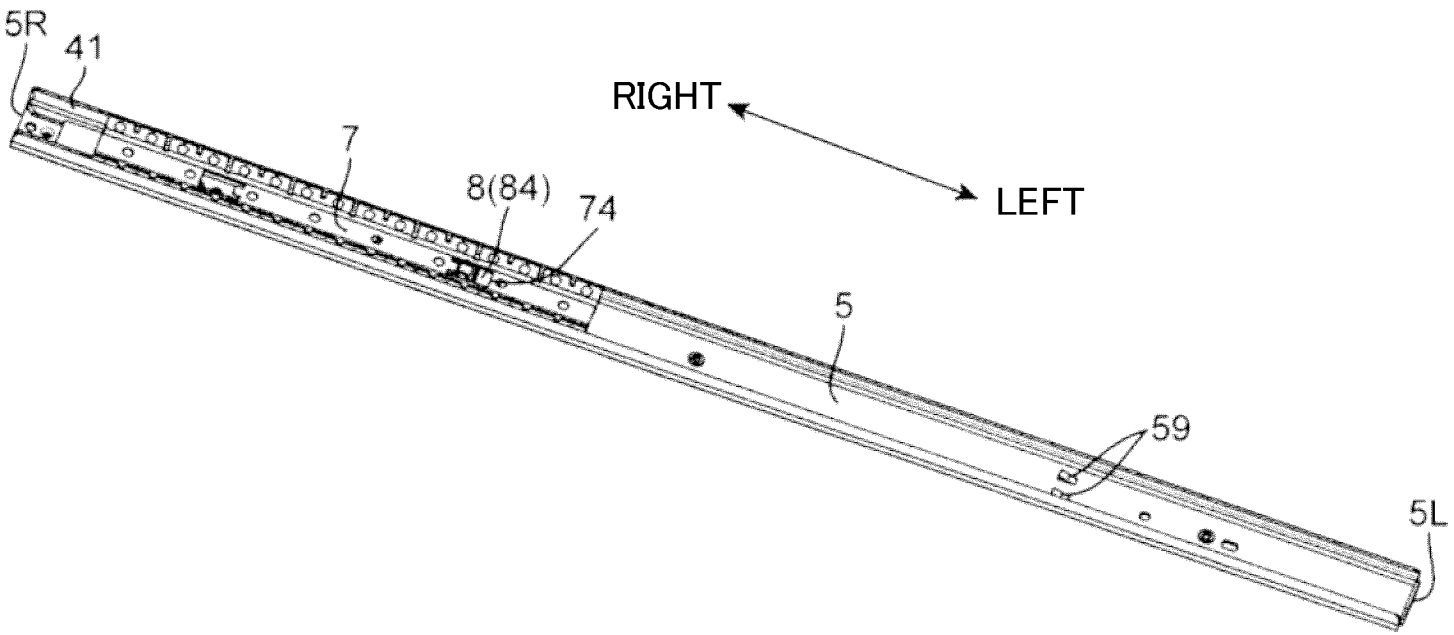
FIGS. 13A and 13B are perspective views showing different states where the ball retainer and a lever member are assembled to the fixed rail.
Figure 13B:
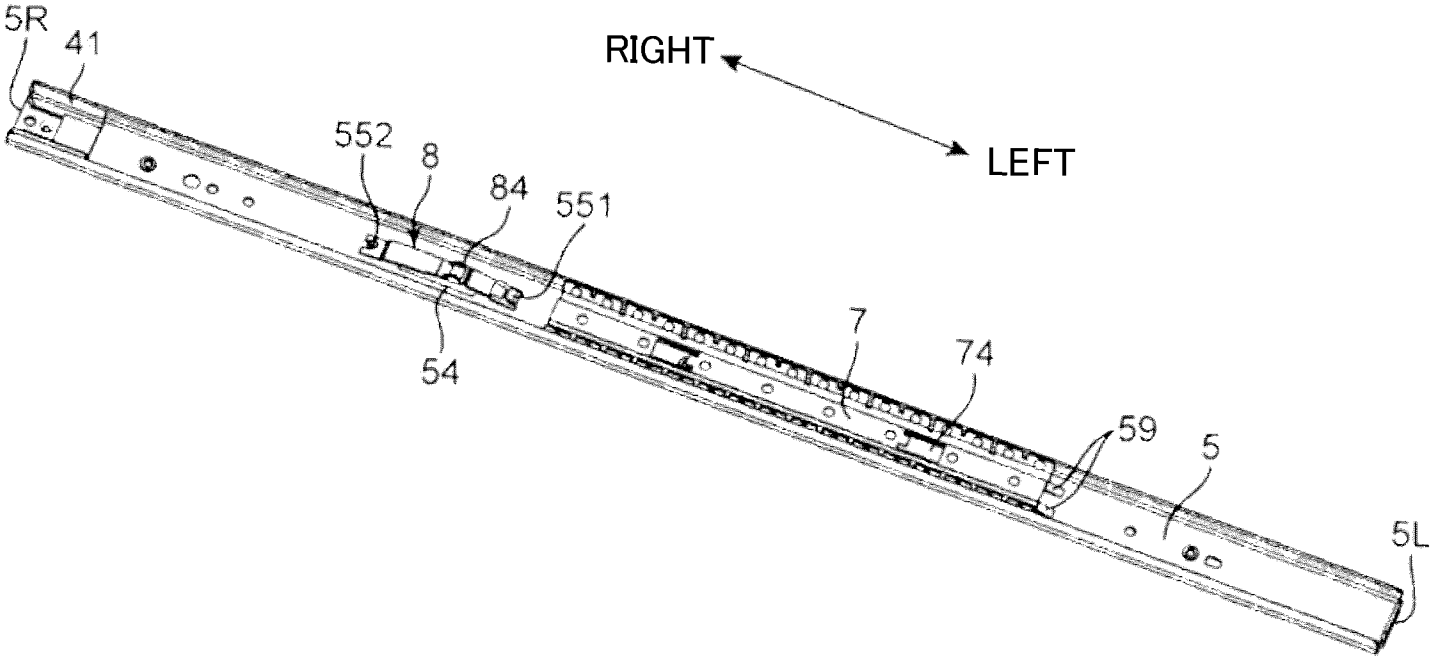

FIGS. 13A and 13B are perspective views showing different states where the ball retainer 7 and the lever member 8 are assembled to the fixed rail 5. FIG. 13A shows a state where the ball retainer 7 is located nearest to the right end 5R of the fixed rail 5 in the range of sliding movement and is a state corresponding to the third state. At this time, the right end of the ball retainer 7 abuts against the stopper 41. In this state, part of the lever member 8 (the pressure receiving portion 84) projects through the window portion 74 of the ball retainer 7, so that the lever member 8 interferes with the ball retainer 7 (i.e., the lever member 8 is in the interfering position). Therefore, the ball retainer 7 is held against sliding movement relative to the fixed rail 5.

Hence, the side surface unit 17 removed from the apparatus body 10 as shown in FIG. 5 can be easily reassembled to the apparatus body 10. Specifically, the ball retainer 7 is locked near the right end 5R (first end) of the fixed rail 5 by the lever member 8. Therefore, in inserting the left end 6L of the movable rail 6 into the right end of the ball retainer 7, the user can insert the left end 6L of the movable rail 6 into the ball retainer 7 locked to the fixed rail 5. Thus, it can be avoided that during insertion the pressure applied from the left end 6L of the movable rail 6 to the ball retainer 7 cause the ball retainer 7 to move behind the apparatus body plane from which the side surface unit 17 is pulled outwardly. Hence, the user can easily insert the left end 6L of the movable rail 6 into the right end of the ball retainer 7.

In other words, when the movable rail 6 is removed, the ball retainer 7 is positioned to come closest to the right end 5R of the fixed rail 5. Therefore, the movable rail 6 once removed can be easily reassembled to the fixed rail 5. Furthermore, the lever member 8 is disposed to lock the ball retainer 7 on the side of the ball retainer 7 closer to the left end 5L (second end) of the fixed rail 5. Therefore, even upon assembly of the movable rail 6 to the fixed rail 5, the locking of the ball retainer 7 is not immediately released. Hence, the assemblability of the movable rail 6 can be improved.

On the other hand, FIG. 13B shows a state where the ball retainer 7 is located nearest to the left end 5L of the fixed rail 5 in the range of sliding movement and is a state corresponding to the a state (first state) where the movable rail 6 is fully retracted in the fixed rail 5. At this time, the left end of the ball retainer 7 abuts against the third turned-out portions 59. In this state, the engagement of the surrounding portion of the pressure receiving portion 84 of the lever member 8 against the periphery of the window portion 74 of the ball retainer 7 is released, so that the ball retainer 7 can slidingly move relative to the fixed rail 5. Therefore, without any influence of the presence of the lever member 8, the ball retainer 7 and the movable rail 6 can be free to slide.

Figure 14B:
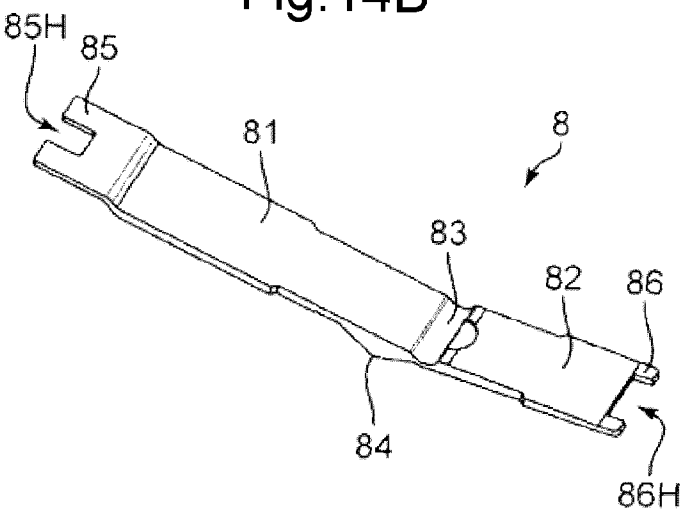
FIGS. 14A and 14B are perspective views of the lever member and FIG. 14C is a side view thereof.
Figure 14A:
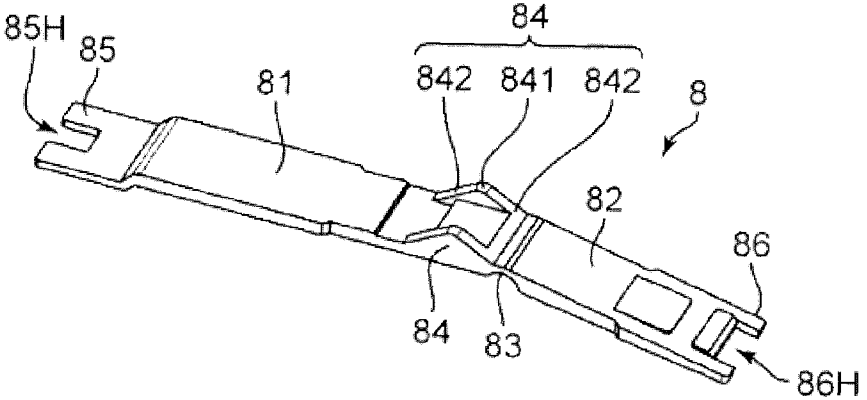
Figure 14C:
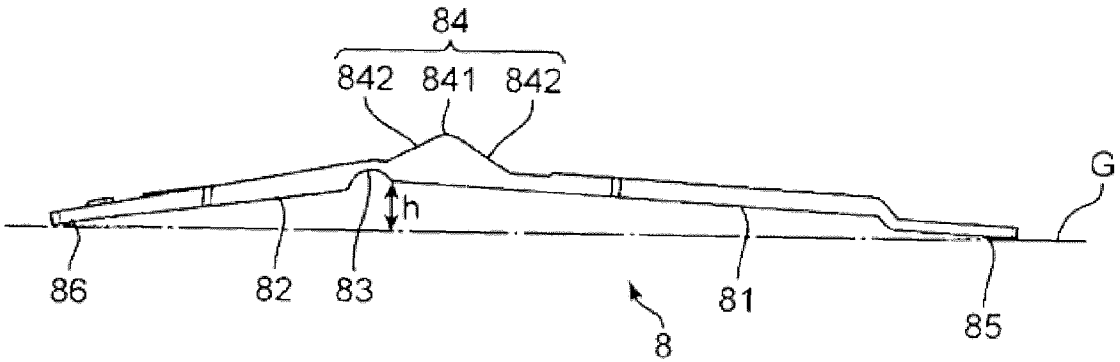

FIG. 14A is a perspective view of the lever member 8, FIG. 14B is a perspective view of the lever member 8 as viewed from a different point of view, and FIG. 14C is a side view of the lever member 8. The lever member 8 is placed between the fixed rail 5 and the ball retainer 7 and engaged, with its position being changeable, to the fixed rail 5. The lever member 8 is a member having an approximately rectangular shape long in the right-and-left direction as viewed from above and a slightly flexed shape as viewed from laterally. The lever member 8 is made of, for example, a resin material or a rubber material using a molding die. The lever member 8 includes: first and second plate portions 81 and 82 (engagement portion); a flexible portion 83 (deformable portion); a pressure receiving portion 84; first holding pieces 85; and second holding pieces 86.

The first plate portion 81 and the second plate portion 82 are substantially flat members each having a predetermined thickness and are connected by the flexible portion 83. The flexible portion 83 has a recess of semiarcuate shape as viewed from laterally. The thickness of the lever member 8 is considerably reduced at the flexible portion 83. The lever member 8 has a form gently bent at the flexible portion 83. Thus, as shown in FIG. 14C, the back surface of the lever member 8 is elevated, near the flexible portion 83, a height h above the ground plane G.

The pressure receiving portion 84 is a portion to be pressed by the pressing portion 66 of the movable rail 6. When a pressing force is applied to the pressure receiving portion 84 from above, the lever member 8 elastically deforms at the flexible portion 83 to result in a more linear form as viewed from laterally. The lever member 8 is deformable at least in the range of the height h. In this embodiment, however, since the opening 54 is provided in the fixed rail 5, the lever member 8 can deform over the height h with the opening 54 as an escape hole. When the pressing force on the pressure receiving portion 84 is cancelled, the flexible portion 83 is restored from the elastic deformation to return to the state shown in FIG. 14C. In other words, the lever member 8 is a member which can elastically deform like a leaf spring since it includes the flexible portion 83.

The pressure receiving portion 84 is formed of a pair of triangular projections projected from the surface of the first plate portion 81 near the flexible portion 83. In practice, the apexes 841 and adjacent regions of the pressure receiving portion 84 are portions to be pushed by the pressing portion 66. The tapered portions 842 inclined downward from the apexes 841 can fit into the grooves 741 provided in the window portions 74 of the ball retainer 7.

The first holding pieces 85 are a pair of lugs extended from an edge of the first plate portion 81 and a first engagement slit 85H is formed between the pair of lugs. Likewise, the second holding pieces 86 are a pair of lugs extended from an edge of the second plate portion 82 and a second engagement slit 86H is formed between the pair of lugs. The first engagement slit 85H can be fitted on the second turned-out portion 552 of the fixed rail 5. The second engagement slit 86H can be fitted on the first turned-out portion 551 of the fixed rail 5. The fitting of these slits is not tight but is such that the lateral movements of the first and second holding pieces 85, 86 are permitted in the respective ranges of depths of the first and second engagement slits 85H, 86H. This configuration can accommodate dimensional variations of the lever member 8 in the right-and-left direction due to the aforementioned elastic deformation.

Figure 15:
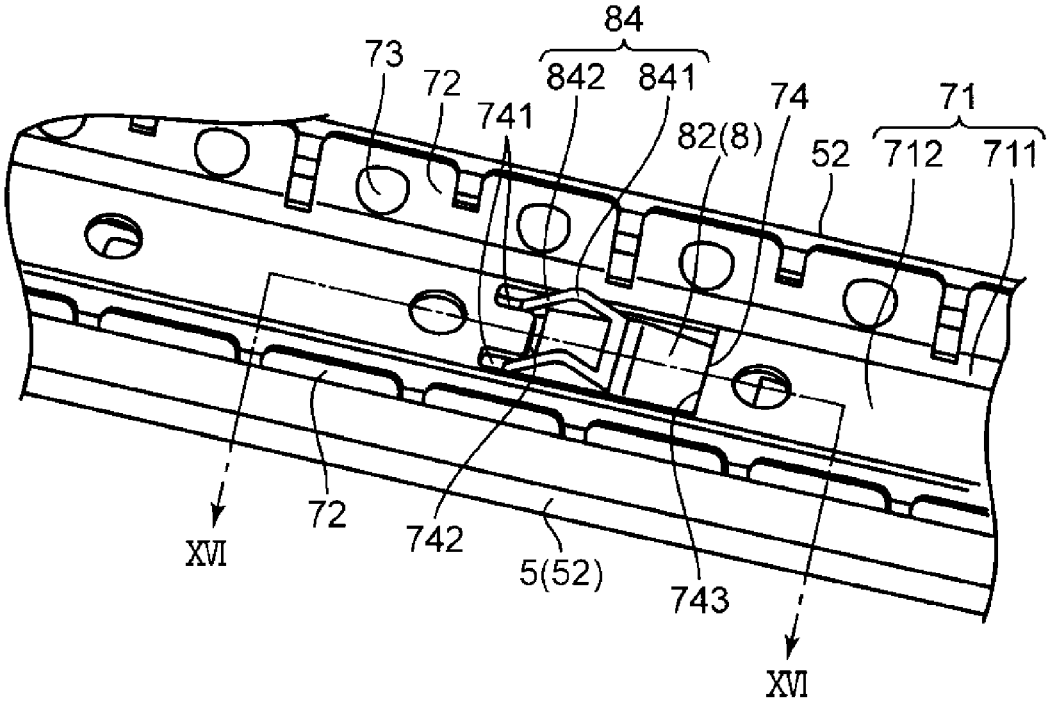
FIG. 15 is a perspective view of the slide rail assembly near a position in which the lever member is disposed.
Figure 16:
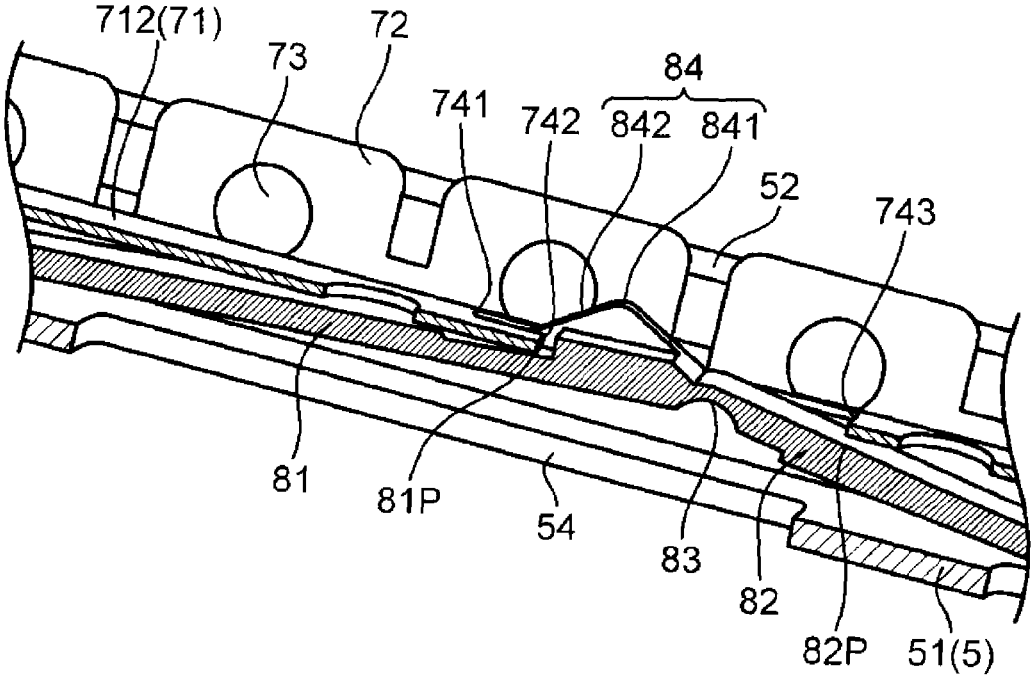
FIG. 16 is a cross-sectional view taken along the line XVI-XVI of FIG. 15.

FIG. 15 is an enlarged perspective view of a relevant portion of the FIG. 13A and FIG. 16 is a cross-sectional view taken along the line XVI-XVI of FIG. 15. As described previously, the position of the lever member 8 shown in these figures is an interfering position in which the pressure receiving portion 84 of the lever member 8 projects through the window portion 74 of the ball retainer 7 and, thus, the lever member 8 and the ball retainer 7 interfere with each other. More specifically, since the apexes 841 of the pressure receiving portion 84 are not pressed, the lever member 8 takes an original position shown in FIG. 14, wherein the pressure receiving portion 84 projects through the window portion 74 beyond the top surface of the rib portion 712 of the ball retainer 7. Furthermore, the tapered portions 842 fit in the grooves 741 extended from the right edge 742 of the window portion 74.

In this state, as shown in FIG. 16, a portion (hereinafter, referred to as a first engagement portion 81P) of the top surface of the first plate portion 81 near the pressure receiving portion 84 is pressed against the under surface of the right edge 742 of the window portion 74. Furthermore, a portion (hereinafter, referred to as a second engagement portion 82P) of the top surface of the second plate portion 82 near the flexible portion 83 is pressed against the under surface of the left edge 743 of the window portion 74. In other words, in this interfering position, the projection of the pressure receiving portion 84 beyond the window portion 74 provides engagement of the first engagement portion 81P and the second engagement portion 82P (part of the lever member) to the peripheral portions of the window portion 74 (part of the holding member). This engagement provides locking of the ball retainer 7 against sliding movement. Particularly, the engagement of the second engagement portion 82P to the under surface of the left edge 743 restricts leftward movement of the ball retainer 7. Thus, the insertion of the removed movable rail 6 into the ball retainer 7 can be facilitated.

When the pressure receiving portion 84 of the lever member 8 in the interfering position is pressed by the pressing portion 66 of the movable rail 6, the lever member 8 is changed to the retreated position in which it is free from interference with the ball retainer 7. Specifically, during transition from the state where the movable rail 6 is fully removed from the fixed rail 5 (the third state) to the state where it is assembled and engaged to the fixed rail 5 (the second state), the pressing portion 66 presses the pressure receiving portion 84 to elastically deform the lever member 8 at the flexible portion 83, so that the lever member 8 changes from the interfering position to the retreated position.

Figure 17A:
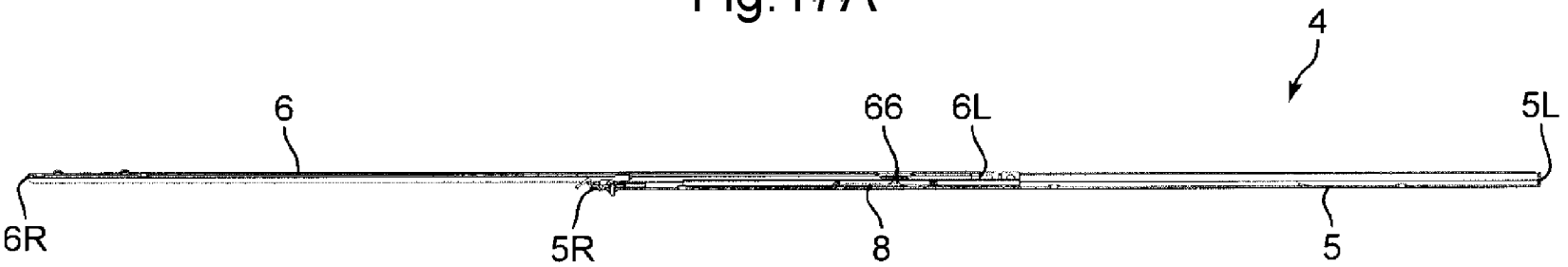
FIG. 17A is a cross-sectional view of the slide rail assembly and FIG. 17B is an enlarged cross-sectional view of a relevant portion of FIG. 17A.
Figure 17B:
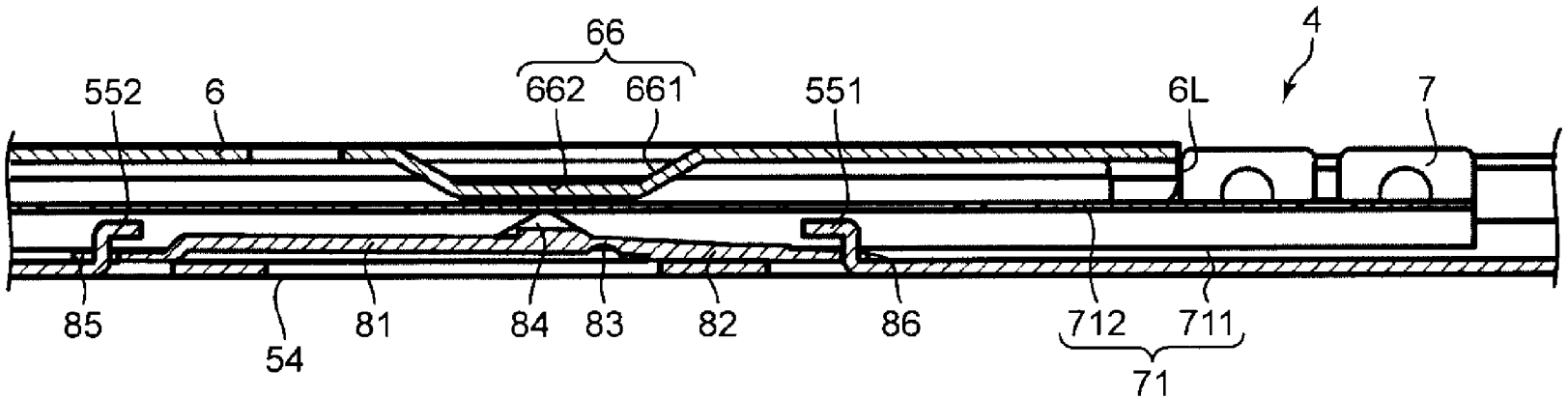

FIG. 17A is a cross-sectional view of the slide rail assembly 4 when the movable rail 6 once removed is being inserted into the fixed rail 5 (or rather the ball retainer 7); and FIG. 17B is an enlarged cross-sectional view of a relevant portion of FIG. 17A. When the left end 6L of the movable rail 6 is slid away from the right end 5R of the fixed rail 5, the ball retainer 7 moves to the rightmost end as shown in FIG. 13A, the window portion 74 is aligned in position with the pressure receiving portion 84 of the lever member 8, and the pressure receiving portion 84 projects through the window portion 74. Therefore, the ball retainer 7 is held against sliding movement and the pressure receiving portion 84 is interferable with the pressing portion 66 of the movable rail 6. Hence, when the left end 6L of the removed movable rail 6 is fitted into the right end 5R of the fixed rail 5 and the movable rail 6 is inserted for a certain length into the ball retainer 7, the pressing portion 66 presses the pressure receiving portion 84. Specifically, an inclined portion 661 of the pressing portion 66 located on the forward side in the direction of insertion first interferes with the tapered portions 842 of the pressure receiving portion 84 and gradually presses down the pressure receiving portion 84 with the progress in insertion of the movable rail 6. Subsequently, a main pressing portion 662 of the pressing portion 66, i.e., a most downwardly projecting portion thereof, presses the apexes 841 of the pressure receiving portion 84.

In this state, the apexes 841 of the pressure receiving portion 84 sink under the window portion 74 and are lowered to substantially the same level as the top surface of the rib portion 712 of the ball retainer 7. Specifically, the lever member 8 elastically deforms at the flexible portion 83 so that the first plate portion 81 and the second plate portion 82 are aligned substantially in a line. Therefore, the first engagement portion 81P and the second engagement portion 82P are no longer engaged to the peripheral portions of the window portion 74 of the ball retainer 7. In other words, the lever member 8 is changed to the retreated position in which it is substantially free from interference with the ball retainer 7. Hence, when a thrust force accompanied by further insertion of the movable rail 6 acts on the ball retainer 7, the ball retainer 7 slidingly moves to the left.

Figure 18A:
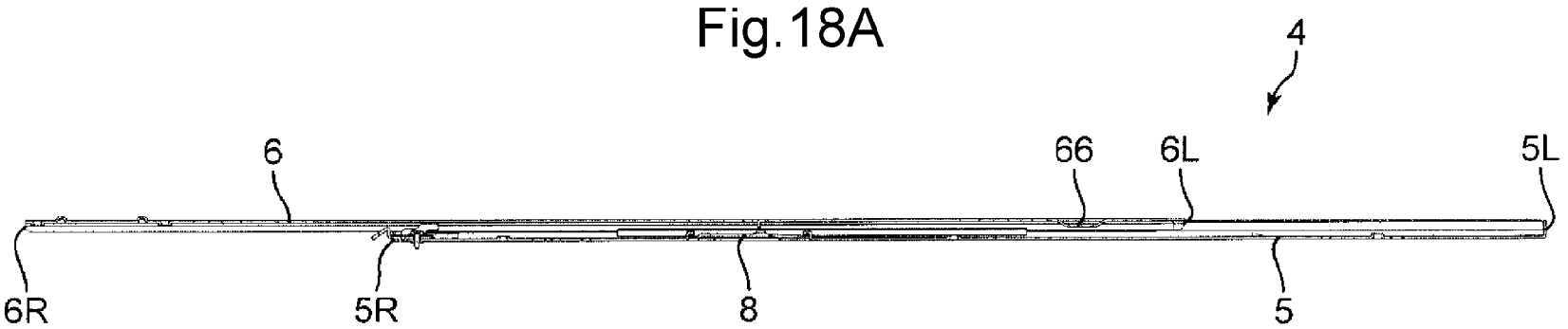
FIG. 18A is another cross-sectional view of the slide rail assembly and FIG. 18B is an enlarged cross-sectional view of a relevant portion of FIG. 18A.
Figure 18B:
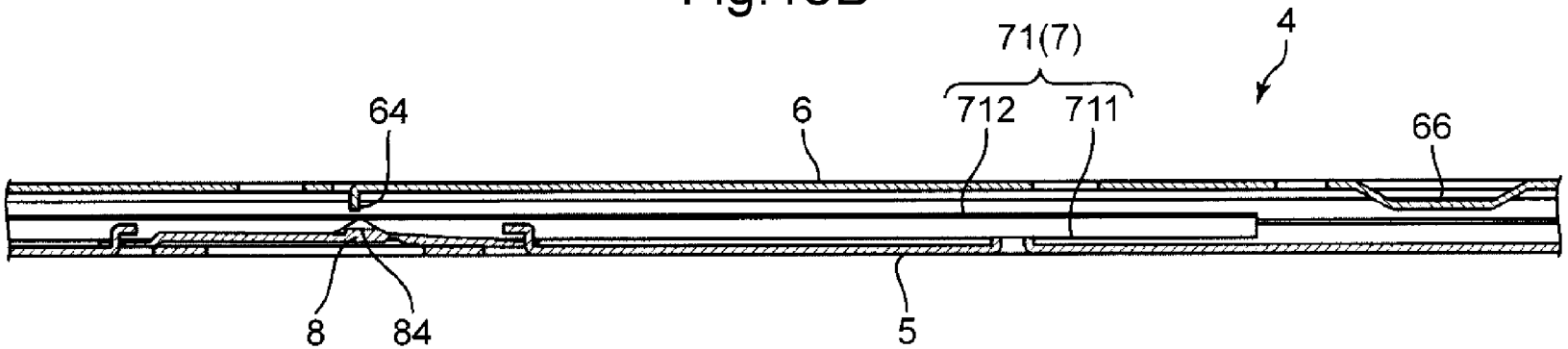

FIG. 18A is a cross-sectional view of the slide rail assembly 4 when the movable rail 6 has been inserted into the fixed rail 5 further than the state shown in FIG. 17A; and FIG. 18B is an enlarged cross-sectional view of a relevant portion of FIG. 18A. In this state, the apexes 841 of the pressure receiving portion 84 come into sliding contact with the back surface of the rib portion 712 of the ball retainer 7. Thus, the lever member 8 maintains its retreated position. This state is such that the apexes 841 is in point contact with the rib portion 712 and, therefore, it has no significant effect on the sliding movement of the ball retainer 7.

In the state where the movable rail 6 is fully retracted in the fixed rail 5 (in the first state), the ball retainer 7 has completely passed through the location of the lever member 8 as shown in FIG. 13B. As a result, the pressing force on the pressure receiving portion 84 of the lever member 8 is released, so that the lever member 8 is restored to the original position (interfering position).

Thereafter, when the movable rail 6 (or rather the side surface unit 17) is pulled outwardly, the ball retainer 7 accordingly moves to the right. During this time, the right end of the ball retainer 7 interferes with the pressure receiving portion 84 of the lever member 8. However, the movable rail 6 is loaded with the weight of the side surface unit 17 and thus has a significant thrust force. Therefore, the ball retainer 7 easily changes the lever member 8 to the retreated position and is free to slide to the right.

With the use of the slide rail assembly 4 according to this embodiment thus far described, in a state where the movable rail 6 is fully removed from the fixed rail 5, the lever member 8 locks the ball retainer 7 against sliding movement relative to the fixed rail 5. This improves the workability of assembly of the removed movable rail 6 through the ball retainer 7 to the fixed rail 5. On the other hand, in a state where the movable rail 6 is fitted to the fixed rail 5, the locking of the ball retainer 7 by the lever member 8 is released. Therefore, an operational feeling of smooth sliding intrinsic to the slide rail assembly 4 is not impaired.

Particularly during reassembly of the removed movable rail 6 to the fixed rail 5, the contact of the pressing portion 66 of the movable rail 6 with the pressure receiving portion 84 of the lever member 8 causes the lever member 8 to change from the interfering position to the retreated position. Thus, the locking of the ball retainer 7 can be released, without otherwise operating the lever member 8, with a simple operation of assembling the movable rail 6 to the fixed rail 5. Therefore, there is no need to provide the lever member 8 with any mechanical operating element and there is no additional operational burden on the user. Furthermore, by the rising and sinking actions of the pressure receiving portion 84 through the window portion 74 of the ball retainer 7, both the locking of the ball retainer 7 and the position change of the lever member 8 can be implemented, which contributes to a simplified structure of the slide rail assembly.

Hence, a slide rail assembly 4 can be provided which provides easy reassembly of the removed movable rail 6 to the fixed rail 5 and maintains an operational feeling of smooth sliding. Particularly in the case of a unit with a large weight, such as the above image forming apparatus 1 including the side surface unit 17, the application of the slide rail assembly 4 according to this embodiment for the sake of pullout of the unit improves the user workability of removal/fitting back of the unit from/to the main body of the image forming apparatus 1.

Although one embodiment of the present disclosure has thus far been described, the present disclosure is not limited to the above embodiment. For example, the present disclosure can take the following modified embodiments.

(1) In the above embodiment, a description has been given of the case where the slide rail assembly 4 according to the present disclosure is applied for the sake of pullout of the side surface unit 17 of the image forming apparatus 1. However, the application of the slide rail assembly 4 is not limited to the above case and the slide rail assembly 4 can be applied for the sake of pullout of the other units of the image forming apparatus 1 or any unit provided in a post-processing device. Besides the image forming apparatus 1, the slide rail assembly 4 of the present disclosure can be widely applied to various apparatuses, including other mechanical apparatuses and electric apparatuses.

(2) In the above embodiment, the lever member 8 including a thin flexible portion 38 and a pressure receiving portion 84 has been illustrated as an example of the fixing part. Instead of this, a metal-made leaf spring member including a portion corresponding to the pressure receiving portion 84 can be used. Alternatively, a combination of a first member including a portion corresponding to the pressure receiving portion 84 and a second member for biasing the first member with a coil spring or a torsion coil spring may be used as the fixing part.

(3) In the above embodiment, the ball retainer 7 has been illustrated as an example of the holding member. Instead of this, a member including sliding rollers or wheels may be used as the holding member.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A slide rail assembly comprising:

a fixed rail including a guiding portion extending in a single direction;

a movable rail changeable among a first state where the movable rail is retracted in the fixed rail, a second state where the movable rail partly extends out from the fixed rail by sliding in the single direction while being guided by the guiding portion, and a third state where the movable rail is fully removed from the fixed rail;

a holding member assembled to the fixed rail, configured to be slidable along the guiding portion in a range of longitudinal extension of the guiding portion, and holding the movable rail to allow sliding movement of the movable rail; and a fixing part configured to, in the third state of the movable rail, lock the holding member against sliding movement relative to the fixed rail and, in the first and second states of the movable rail, release the locking of the holding member.

2. The slide rail assembly according to claim 1, wherein the fixing part is changeable in position between an interfering position where the fixing part interferes with the holding member and a retreated position where the fixing part is free from interference with the holding member, the fixing part in the interfering position being configured to lock the holding member, and the fixing part is configured to, during transition from the third state of the movable rail to the second state thereof where the movable rail is assembled to the fixed rail, come into contact with the movable rail to change from the interfering position to the retreated position.

3. The slide rail assembly according to claim 2, wherein the movable rail includes a pressing portion, the fixing part is a lever member including: a pressure receiving portion configured to be pressed by the pressing portion when the lever member is in the interfering position; an engagement portion configured to be engaged to part of the holding member in the interfering position of the lever member and disengaged from the part of the holding member in the retreated position of the lever member; and a deformable portion elastically deforming when the lever member changes the position, and during transition from the third state of the movable rail to the second state thereof where the movable rail is assembled to the fixed rail, the pressing portion presses the pressure receiving portion to elastically deform the lever member at the deformable portion, so that the engagement portion is disengaged from the holding member to change the lever member from the interfering position to the retreated position.

4. The slide rail assembly according to claim 3, wherein the holding member is a ball retainer placed between the fixed rail and the movable rail and holding a plurality of balls capable of rolling along the guiding portions and including a window portion, the lever member is placed between the fixed rail and the ball retainer and engaged to the fixed rail with the position of the lever member being changeable, when the lever member is in the interfering position, the pressure receiving portion projects through the window portion to become interferable with the pressing portion of the movable rail and the part of the lever member engages the ball retainer around the window portion, and when the pressure receiving portion is pressed by the pressing portion, the pressure receiving portion sinks under the window portion to change the lever member from the interfering position to the retreated position.

5. The slide rail assembly according to claim 4, wherein the fixed rail includes: a first end beyond which the movable rail is extendable; and a second end opposite to the first end, the ball retainer is engaged to the lever member when coming closest to the first end of the fixed rail, and the lever member is disposed so that the engagement of the ball retainer to the lever member is done on the side of the ball retainer closer to the second end of the fixed rail.

6. The slide rail assembly according to claim 1, wherein the holding member is a ball retainer placed between the fixed rail and the movable rail and holding a plurality of balls capable of rolling along the guiding portions.

7. An image forming apparatus comprising:

an apparatus body housing devices for use in forming an image;

a unit capable of being horizontally pulled out of the apparatus body; and a slide rail assembly supporting the unit to allow horizontal sliding movement of the unit, the slide rail assembly comprising:

a fixed rail including a guiding portion extending in a single direction;

a movable rail changeable among a first state where the movable rail is retracted in the fixed rail, a second state where the movable rail partly extends out from the fixed rail by sliding in the single direction while being guided by the guiding portion, and a third state where the movable rail is fully removed from the fixed rail;

a holding member assembled to the fixed rail, configured to be slidable along the guiding portion in a range of longitudinal extension of the guiding portion, and holding the movable rail to allow sliding movement of the movable rail; and a fixing part configured to, in the third state of the movable rail, lock the holding member against sliding movement relative to the fixed rail and, in the first and second states of the movable rail, release the locking of the holding member, wherein the fixed rail is mounted to the apparatus body and the movable rail is mounted to the unit.

8. The image forming apparatus according to claim 7, wherein the fixing part is changeable in position between an interfering position where the fixing part interferes with the holding member and a retreated position where the fixing part is free from interference with the holding member, the fixing part in the interfering position being configured to lock the holding member, and the fixing part is configured to, during transition from the third state of the movable rail to the second state thereof where the movable rail is assembled to the fixed rail, come into contact with the movable rail to change from the interfering position to the retreated position.

9. The image forming apparatus according to claim 8, wherein the movable rail includes a pressing portion, the fixing part is a lever member including: a pressure receiving portion configured to be pressed by the pressing portion when the lever member is in the interfering position; an engagement portion configured to be engaged to part of the holding member in the interfering position of the lever member and disengaged from the part of the holding member in the retreated position of the lever member; and a deformable portion elastically deforming when the lever member changes the position, and during transition from the third state of the movable rail to the second state thereof where the movable rail is assembled to the fixed rail, the pressing portion presses the pressure receiving portion to elastically deform the lever member at the deformable portion, so that the engagement portion is disengaged from the holding member to change the lever member from the interfering position to the retreated position.

10. The image forming apparatus according to claim 9, the holding member is a ball retainer placed between the fixed rail and the movable rail and holding a plurality of balls capable of rolling along the guiding portions and including a window portion, the lever member is placed between the fixed rail and the ball retainer and engaged to the fixed rail with the position of the lever member being changeable, when the lever member is in the interfering position, the pressure receiving portion projects through the window portion to become interferable with the pressing portion of the movable rail and the part of the lever member engages the ball retainer around the window portion, and when the pressure receiving portion is pressed by the pressing portion, the pressure receiving portion sinks under the window portion to change the lever member from the interfering position to the retreated position.

11. The image forming apparatus according to claim 10, the fixed rail includes: a first end beyond which the movable rail is extendable; and a second end opposite to the first end, the ball retainer is engaged to the lever member when coming closest to the first end of the fixed rail, and the lever member is disposed so that the engagement of the ball retainer to the lever member is done on the side of the ball retainer closer to the second end of the fixed rail.

12. The image forming apparatus according to claim 7, wherein the holding member is a ball retainer placed between the fixed rail and the movable rail and holding a plurality of balls capable of rolling along the guiding portions.

* * * * *